US008907197B2

(12) United States Patent
Okuda

(10) Patent No.: US 8,907,197 B2
(45) Date of Patent: Dec. 9, 2014

(54) PERFORMANCE INFORMATION PROCESSING APPARATUS, PERFORMANCE INFORMATION PROCESSING METHOD, AND PROGRAM RECORDING MEDIUM FOR DETERMINING TEMPO AND METER BASED ON PERFORMANCE GIVEN BY PERFORMER

(71) Applicant: Casio Computer Co., Ltd., Shibuya-ku, Tokyo (JP)

(72) Inventor: Hiroko Okuda, Kokubunji (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 14/015,203

(22) Filed: Aug. 30, 2013

(65) Prior Publication Data

US 2014/0060287 A1 Mar. 6, 2014

(30) Foreign Application Priority Data

Aug. 31, 2012 (JP) ..... 2012-191909

(51) Int. Cl.

| | |
|---|---|
| ***G10H 1/18*** | (2006.01) |
| ***G10H 7/00*** | (2006.01) |
| ***G10H 1/42*** | (2006.01) |
| ***G10H 1/40*** | (2006.01) |

(52) U.S. Cl.

CPC ..... *G10H 1/42* (2013.01); *G10H 2210/076* (2013.01); *G10H 1/40* (2013.01)

USPC ..... 84/635; 84/636

(58) Field of Classification Search

USPC ..... 84/611, 636, 612, 635

See application file for complete search history.

(56) References Cited

U.S. PATENT DOCUMENTS

| | | | | |
|---|---|---|---|---|
| 5,256,832 | A * | 10/1993 | Miyake | 84/636 |
| 5,913,259 | A * | 6/1999 | Grubb et al. | 84/610 |
| 7,582,824 | B2 * | 9/2009 | Sumita | 84/612 |
| 7,714,222 | B2 * | 5/2010 | Taub et al. | 84/600 |
| 8,314,320 | B2 | 11/2012 | Okuda | |
| 8,471,135 | B2 * | 6/2013 | Taub et al. | 84/616 |
| 8,502,057 | B2 * | 8/2013 | Ikeya et al. | 84/612 |
| 2008/0034948 | A1 * | 2/2008 | Sumita | 84/636 |
| 2009/0031884 | A1 * | 2/2009 | Arai et al. | 84/609 |

FOREIGN PATENT DOCUMENTS

JP 2011-158855 A 8/2011

* cited by examiner

*Primary Examiner* — Jeffrey Donels

(74) *Attorney, Agent, or Firm* — Holtz, Holtz, Goodman & Chick PC

(57) ABSTRACT

A performance-information processing apparatus processes performance information entered thereto. When the performance information is entered in a time interval between (i) a starting time point, at which performance information of one note starts entering and (ii) a first timing, that is a certain time after another performance information of a note has been entered after the performance information of said one note was entered, a tempo determining unit determines a tempo of the performance information, based on the performance information entered in the time interval, and a meter determining unit which determines a meter of the performance information based on the tempo determined by the tempo determining unit.

20 Claims, 12 Drawing Sheets

| | |
|---|---|
| PATTERN 1 | SIXTEENTH NOTE + SIXTEENTH NOTE + HALF NOTE |
| ⋮ | |
| PATTERN 4 | EIGHTH NOTE + EIGHTH NOTE + HALF NOTE |
| ⋮ | |

PERFORMANCE INFORMATION PROCESSING APPARATUS, PERFORMANCE INFORMATION PROCESSING METHOD, AND PROGRAM RECORDING MEDIUM FOR DETERMINING TEMPO AND METER BASED ON PERFORMANCE GIVEN BY PERFORMER

CROSS-REFERENCE TO RELATED APPLICATIONS

The present application is based upon and claims the benefit of priority from the prior Japanese Patent Application No. 2012-191909, filed Aug. 31, 2012, the entire contents of which are incorporated herein by reference.

BACKGROUND OF THE INVENTION

1. Field of the Invention

The present invention relates to a performance information processing apparatus, a performance information processing method, and a program recording medium for determining a tempo and a meter based on a performance given by a performer.

2. Description of the Related Art

When a player plays an electronic musical instrument provided with a keyboard, such as electronic pianos and electronic organs, in general, the player plays a melody with his/her right hand and plays an accompaniment with his/her left hand, or presses plural keys composing codes with his/her left hand. Therefore, the player of such instrument having a keyboard is required to practice to move his/her right and left hands independently from the other in accordance with a score.

At any rate, in playing the piano or in playing the organ, the player is required to simultaneously move his/her right and left hands in different ways. Accordingly, the user has to do reasonable practices. In particular, there are many beginner players, who can move his/her right hand to play a melody but feel difficulty in moving his/her left hand simultaneously to give other performance.

Under the circumstance, for instance, an electronic musical instrument is disclosed by Japanese Unexamined Patent Publication No. 2011-158855, in which instrument is able of automatically generating accompaniment tones to be played with his/her left hand, when the performer plays a melody with his/her right hand.

The electronic musical instrument disclosed in the above Japanese Unexamined Patent Publication No. 2011-158855, gives codes in real time, when the performer plays a melody to enter performance information. But the performer is required to give performance in a predetermined tempo, and therefore, there is a disadvantage that the performer's intended codes are not added, when the performance is not given in the predetermined tempo. When the performer plays a melody, it is necessary to determine a tempo and meter in accordance with note durations of the melody.

The present invention provides a performance information processing apparatus, which can determine a tempo and a meter based on note durations of a melody played by a performer.

SUMMARY OF THE INVENTION

According to one aspect of the invention, there is provided a performance-information processing apparatus, which comprises a tempo determining unit which determines a tempo of performance information, based on the performance information entered in a time interval between (i) a starting time point, at which one note out of at least two notes in the performance information starts entering and (ii) a first timing, that is a certain time after another note has been entered after said one note was entered, and a meter determining unit which determines a meter of the performance information based on the tempo determined by the tempo determining unit.

DETAILED DESCRIPTION OF THE PREFERRED EMBODIMENTS

Now, preferred embodiments of the present invention will be described with reference to the accompanying drawings in detail.

Figure 1:
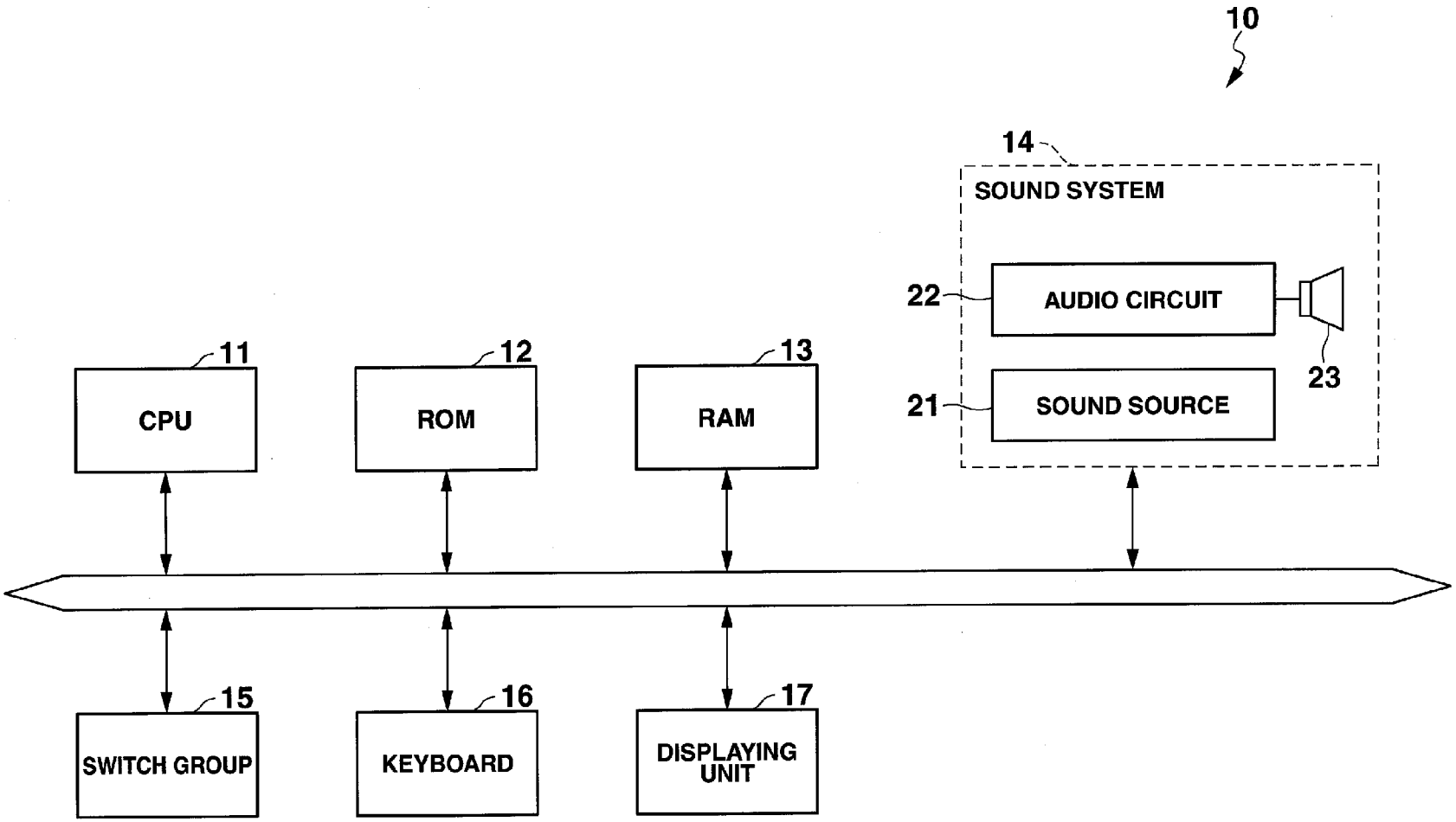
FIG. 1 is a block diagram of a configuration of an electronic musical instrument, to which a performance-information processing apparatus according the embodiment of the present invention is applied.

FIG. 1 is a block diagram of a configuration of an electronic musical instrument 10, to which a performance information processing apparatus according the embodiment of the present invention is applied. As shown in FIG. 1, the electronic musical instrument 10 comprises CPU (Central Processing Unit) 11, ROM (Read Only Memory) 12, RAM (Random Access Memory) 13, a sound system 14, a switch group 15, a keyboard 16, and a displaying unit 17.

CPU 11 serves to control the whole operation of the electronic musical instrument 10. Further, CPU 11 performs various processes, including a process of detecting pressed keys of the keyboard 16 and operated switches of the switch group 15, a process of controlling operation of the sound system in response to operations of keys of the keyboard 16 and switches of the switch group 15, a process of deciding beats and tempos in accordance with entered pitch information, and the like.

ROM 12 stores programs for CPU 11 to perform various processes. Further, ROM 12 has a waveform area for storing waveform data. The waveform data is used for generating musical tones of pianos, guitars, bass drums, snare drums, cymbals, and the like. RAM 13 serves to store the programs read by CPU 11 from ROM 12 and to temporarily store data generated in the process performed by CPU 11.

The sound system 14 comprises a sound source 21, an audio circuit 22 and a speaker 23. Upon receipt of information relating to a pressed key of the keyboard 16 from CPU 11, the sound source 21 reads an appropriate waveform data from the waveform data area of ROM 12 to generate and output musical tone data of an appropriate pitch. Further, the sound source 21 reads the waveform data at a reading rate corresponding to a predetermined pitch, particularly, waveform data of tone colors of percussion instruments such as bass drums, snare drums, and cymbals, and outputs musical note data of the waveform data. The audio circuit 22 converts the musical note data into an analog signal, amplifying the analog signal. The analog signal is output as an audio signal through the speaker 23.

Figure 2:
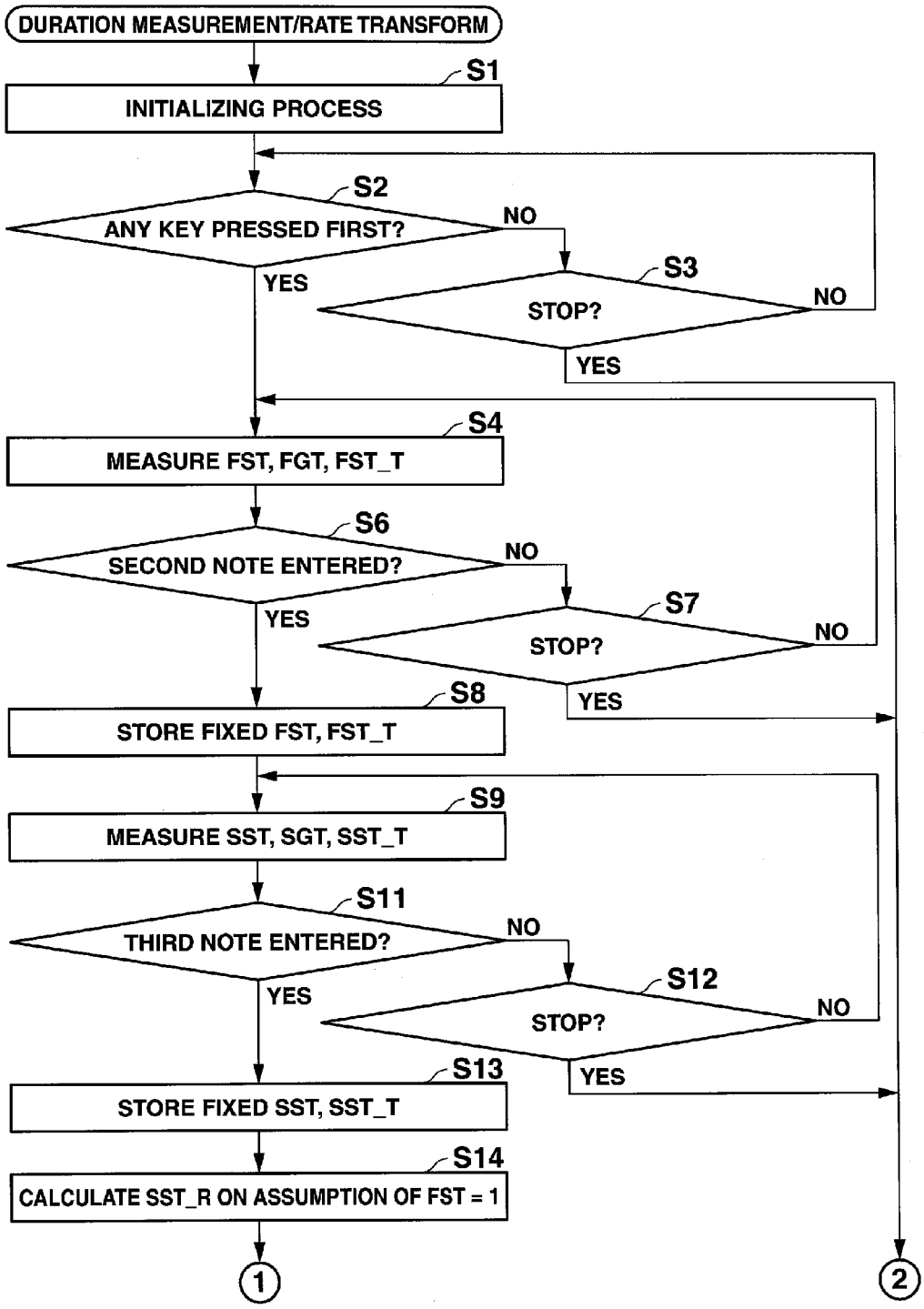
FIG. 2 and FIG. 3 are flow charts showing an example of a process of duration measurement/rate transform performed in the electronic musical instrument, to which the performance-information processing apparatus according the embodiment of the present invention is applied.
Figure 3:
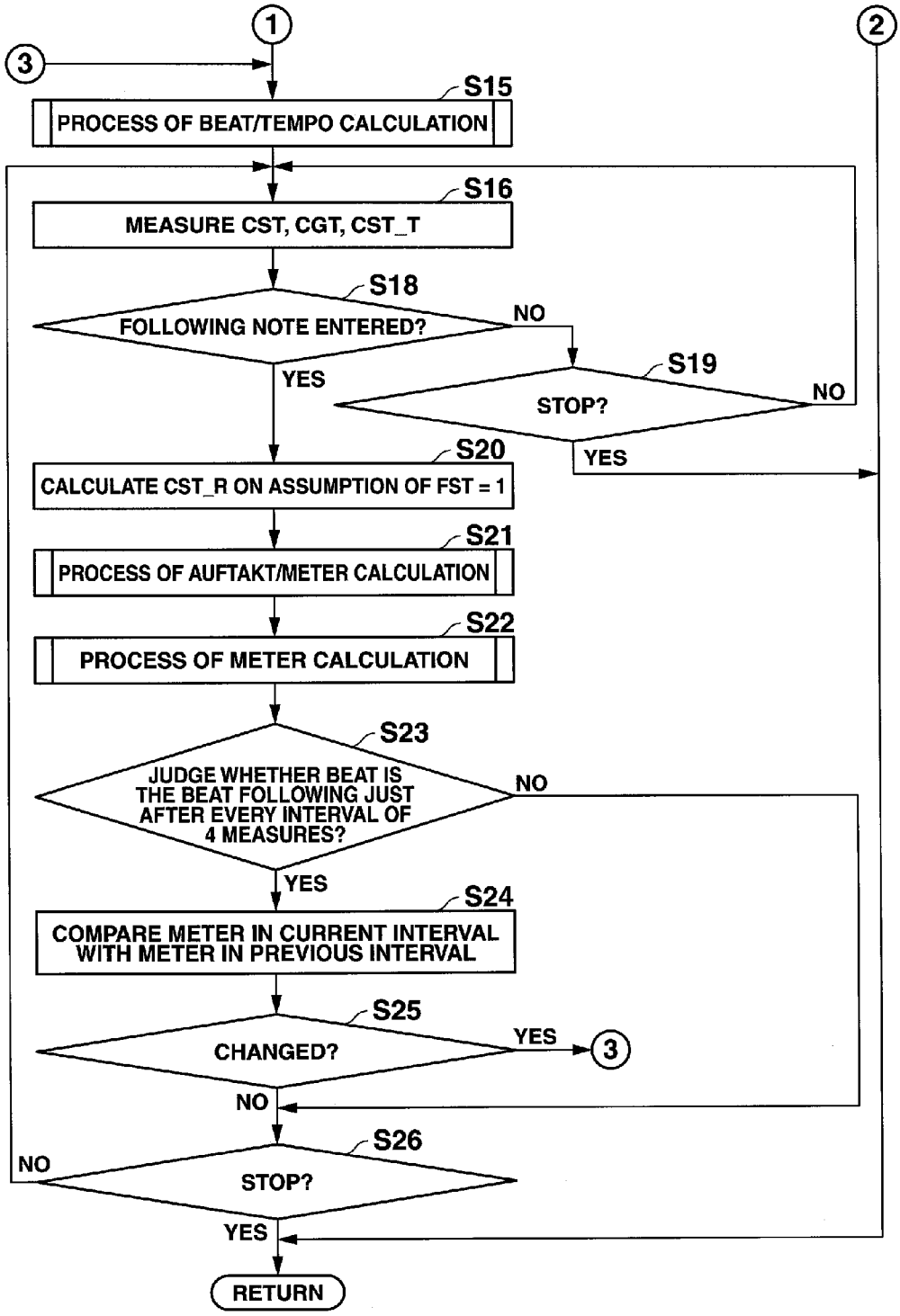

The process performed in the electronic musical instrument 10 according to the present embodiment will be described in detail. FIG. 2 and FIG. 3 are flow charts showing an example of a process of duration measurement/rate transform performed in the electronic musical instrument 10, to which the performance-information processing apparatus according to the present embodiment is applied.

When the power of the electronic musical instrument 10 is turned on, CPU 11 of the electronic musical instrument 10 performs an initializing process, clearing data in RAM 13 and an image displayed on the displaying unit 17 (step S1 in FIG. 2).

Then, CPU 11 judges whether any key has been pressed first (step S2). When it is determined NO at step S2, CPU 11 advances to step S3, judging whether a performance has stopped. In other words, CPU 11 judges whether a performance stopping switch (not shown) of the instrument 10 has been pressed. When it is determined YES at step S3, CPU 11 finishes the process of duration measurement/rate transform. When it is determined NO at step S3, CPU 11 returns to step S2. Therefore, as far as a performance is not stopped, CPU 11 repeatedly makes judgment at step S2 until any key is pressed initially. When it is determined YES at step S2, CPU 11 obtains performance information and advances to step S4.

In the process at step S4, CPU 11 measures FST (First Step Time), FGT (First Gate Time), and FST-T (Net time duration of First Step Time). ST (Step Time) and GT (Gate Time) will be described before explaining FST and FGT.

ST is a numerical value corresponding to a time duration between a time, at which a note starts generating a sound and the following time, at which the following note starts generating a sound. For example, when the time duration between a time, at which a note starts generating a sound and a time, at which the following note starts generating a sound corresponds to the time duration of a quarter note, then it will be determined that the numerical value is "480". Meanwhile, GT is a numerical value corresponding to a time duration between a time, at which a key of the keyboard 14 is pressed and a time, at which the pressed key is released. For example, in the case that the quarter note is played, if a duration, in which the key of the keyboard 16 is kept pressed is shorter than the duration of a quarter note, then the numerical value will be "475".

Using ST and GT explained above, FST, FGT and FST-T will be described. FST is ST of the performance information entered first, and FGT is GT of the performance information entered first. FST-T is the net time duration of FST, that is, corresponds to "0.5" seconds.

The process at step S4 is repeatedly performed, until it is determined YES at step S6, and therefore FST, FGT and FST-T will be fixed at the time when it has been determined YES at step S6. The process at step S6 will be described later.

In the process at step S6, CPU 11 judges whether the following note, that is, the second note has been entered. When it is determined YES at step S6, CPU 11 obtains the performance information, and advances to step S8. When it is determined NO at step S6, CPU 11 advances to step S7.

In the process at step S7, CPU 11 judges whether the performance has stopped. More particularly, the process at step S7 is performed in the same manner as the process at step S3. When it is determined YES at step S7, CPU 11 finishes the process of duration measurement/rate transform. When it is determined NO at step S7, CPU 11 returns to step S4.

In the process at step S8, CPU 11 stores in RAM 13 FST and FST-T, which are fixed at the time when it is determined at step S6 that the second note has been entered.

In the process at step S9, CPU 11 measures SST (Second Step Time), SGT (Second Gate Time), and SST-T (Net time duration of Second Step Time). SST is ST of the second entered performance information, and FGT is GT of the second entered performance information. SST-T is the net time duration of SST.

The process at step S9 is repeatedly performed, until it is determined YES at step S11, and therefore SST, SGT and SST-T will be fixed at the time when it is determined YES at step S11. The process at step S11 will be described later.

In the process at step S11, CPU 11 judges whether the following note, that is, the third note has been entered. When it is determined YES at step S11, CPU 11 obtains the performance information, and advances to step S13. When it is determined NO at step S11, CPU 11 advances to step S12.

In the process at step S12, CPU 11 judges whether the performance has stopped. In other words, the process at step S12 is performed in the same manner as the process at step S3. When it is determined YES at step S12, CPU 11 finishes the process of duration measurement/rate transform. When it is determined NO at step S12, CPU 11 returns to step S9.

In the process at step S13, CPU 11 stores in RAM 13 SST and SST-T, which are fixed at the time when it has been determined at step S11 that the third note is entered.

In the process at step S14, CPU 11 calculates SST-R, which is a ratio of SST to FST, on the assumption that the numerical value of FST is set to 1, and stores the result of the calculation in RAM 13. In order to prevent fluctuation in the performance by human from influencing on the following process, it is possible to round an error to a predetermined accuracy, or to select the most appropriate ratio from among plural ratios, when SST-R is calculated, that is, when the ratio of SST to FST is calculated.

In the process at step S15 in FIG. 3, CPU 11 performs a process of beat/tempo calculation. The process of beat/tempo calculation will be described with reference to flow charts of FIG. 4 and FIG. 5, later.

In the process at step S16, CPU 11 measures CST (Current Step Time), CGT (Current Gate Time), and CST-T (Net time duration of Current Step Time). CST is ST of the currently entered performance information, and CGT is GT of the currently entered performance information. CST-T is the net time duration of CST.

The process at step S16 is repeatedly performed, until it is determined YES at step S18, and therefore CST, CGT and CST-T will be fixed at the time when it has been determined YES at step S18. The process at step S18 will be described later.

When CST, CGT and CST-T are fixed, it is possible to perform a process for quantizing the numerical values of CST, CGT and CST-T respectively to durations of predetermined notes in an appropriate tempo value, reducing influence of the fluctuation in the performance by human.

In the process at step S18, CPU 11 judges whether the following note has been entered. When it is determined YES at step S18, CPU 11 obtains the performance information, and advances to step S20. When it is determined NO at step S18, CPU 11 advances to step S19.

In the process at step S19, CPU 11 judges whether the performance has stopped. In other words, the process at step S19 is performed in the same manner as the process at step S3 in FIG. 2. When it is determined YES at step S19, CPU 11 finishes the process of duration measurement/rate transform. When it is determined NO at step S19, CPU 11 returns to step S16.

In the process at step S20, CPU 11 calculates CST-R, which is a ratio of CST to FST, on the assumption that the numerical value of FST is set to 1, and stores the result of the calculation in RAM 13.

In the process at step S21, CPU 11 performs a process of anacrusis/meter calculation. The process of anacrusis/meter calculation will be described with reference to flow charts of FIG. 6 to FIG. 8, later.

In the process at step S22, CPU 11 performs a process of meter calculation. The process of meter calculation will be described with reference to flow charts of FIG. 9 and FIG. 10, later.

In the process at step S23, CPU 11 judges whether a beat to be judged is the beat following immediately after every interval of 4 measures. In other words, in the case of a triple meter (Beat=3), it is judged whether the beat is the (12×n+1)-th beat, and in the case of a quadruple meter (Beat=4), it is judged whether the beat is the (16×n+1)-th beat, where n is an integer of not less than 0. When it is determined YES at step S23, CPU 11 advances to step S24. When it is determined NO at step S23, CPU 11 advances to step S26.

The meter to be judged in the process at step S23 is the meter fixed in the process of anacrusis/meter calculation and the process of meter calculation.

In the process at step S24, CPU 11 compares the meter in the current interval with the meter in the previous interval. The "current interval" is 4 measures, which contain beats to be processed in the just previous process of anacrusis/meter calculation and the process of meter calculation. In other words, in the case of a triple meter (Beat=3), the "current interval" is 4 measures from the (12×(n−1)+1)-th beat to the (12×n)-th beat, and in the case of a quadruple meter (Beat=4), the "current interval" is 4 measures from the (16×(n−1)+1)-th beat to the (16×n)-th beat, where n is an integer of not less than 1. The "previous interval" is 4 measures just previous to the "current interval". That is, in the process at step S24, the meter determined in the process at step S23 are compared with the meter fixed previously.

In the process at step S25, CPU 11 judges whether the meter has changed, that is, judges whether the meter in the current interval has changed from the meter in the previous interval. When it is determined YES at step S25, CPU 11 returns to step S15. When it is determined NO at step S25, CPU 11 advances to step S26.

That is, when it is determined at step S25 that the meter has changed (YES at step S25), CPU 11 performs the process of beat/tempo calculation, again.

In the process at step S26, CPU 11 judges whether the performance has stopped. In other words, the process at step S26 is performed in the same manner as the process at step S3. When it is determined YES at step S26, CPU 11 finishes the process of duration measurement/rate transform. When it is determined NO at step S26, CPU 11 returns to step S16.

Figure 4:
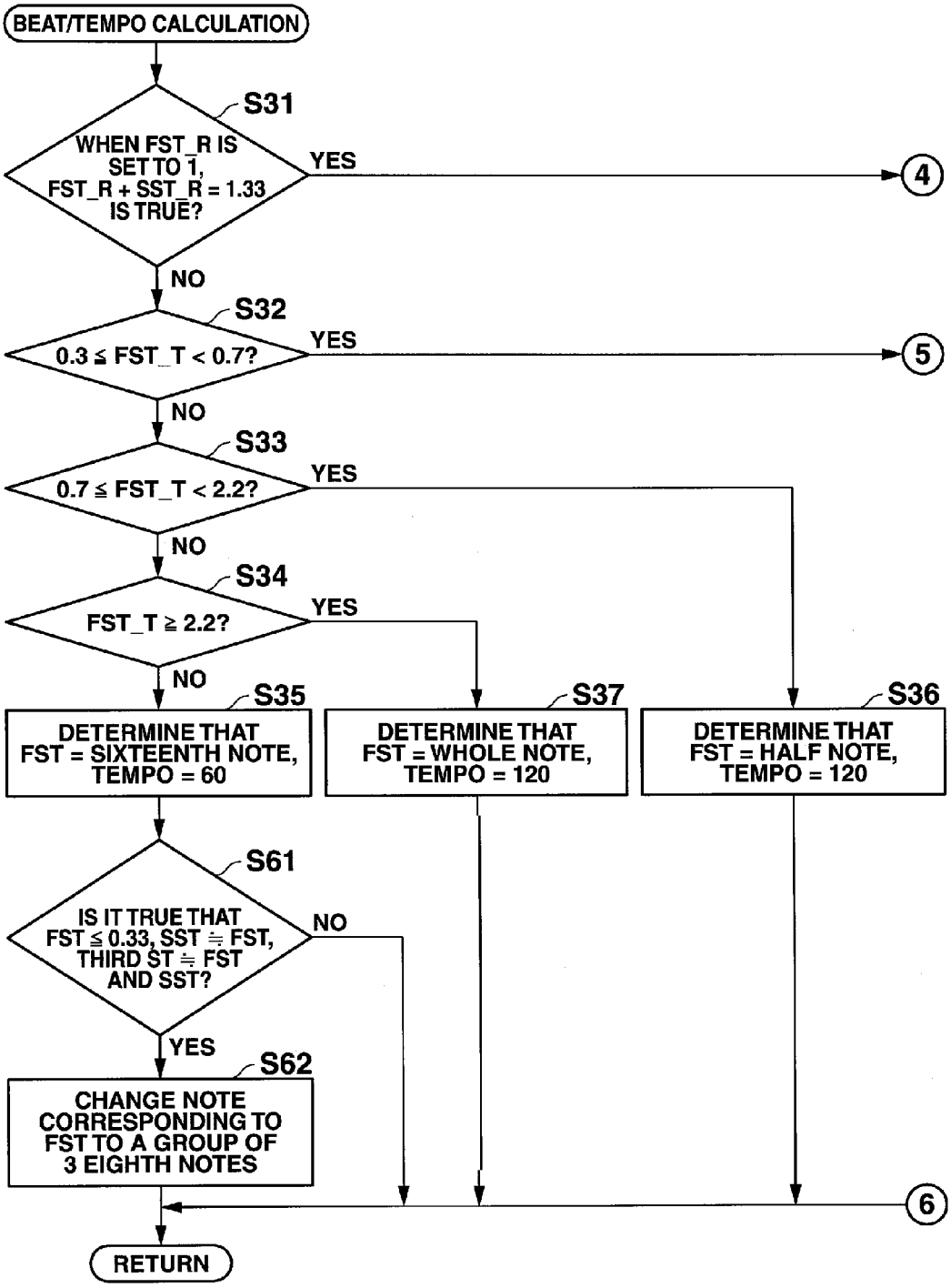
FIG. 4 and FIG. 5 are flow charts showing an example of a process of beat/tempo calculation performed in the electronic musical instrument, to which the performance-information processing apparatus according to the embodiment of the present invention is applied.
Figure 5:
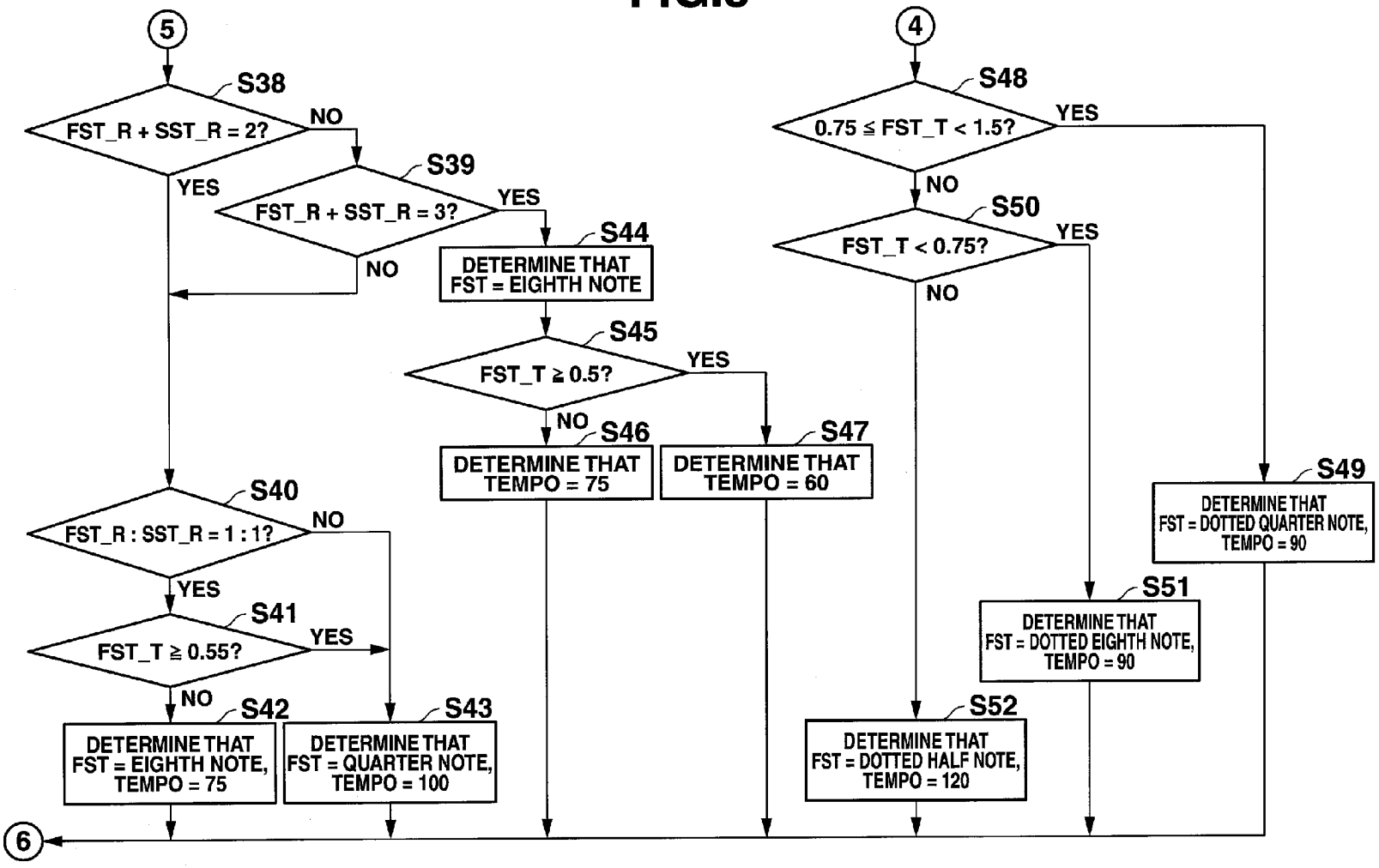

FIG. 4 and FIG. 5 are flow charts showing an example of the process of beat/tempo calculation performed in the electronic musical instrument 10, to which the performance-information processing apparatus according to the present embodiment is applied.

In the process at step S31 in FIG. 4, CPU 11 judges whether FST-R+SST-R=1.33 is true, when FST-R is set to 1. More particularly, it is judged whether SST, that is, ST of the second entered performance information is about one third in duration of FST, that is, ST of the first entered performance information. If it is true that SST is about one third of FST in duration, then the following cases will be true: the case (1)—FST is a dotted half note and SST is a quarter note; the case (2)—FST is a dotted quarter note and SST is an eighth note; and the case (3)—FST is a dotted eighth note and SST is a sixteenth note. When it is determined at step S31 that FST-R+SST-R=1.33 is true (YES at step S31), CPU 11 advances to step S48 in FIG. 5. When it is determined NO at step S31, CPU 11 advances to step S32. In the process at step S31, it is possible for CPU 11 to judge whether FST-R+SST-R=1.33±α is true. In this case, some allowance can be included, because different from a machine giving an accurate performance, a player not always gives a performance on correct time and it is hard to assure that FST-R+SST-R=1.33.

When it is determined at step S31 that FST-R+SST-R=1.33 is true (YES at step S31), the case will be described, in which FST is either of a dotted half note, a dotted quarter note, and a dotted eighth note.

When it is determined YES at step S31, CPU 11 judges whether FST-T is not less than 0.75 sec and less than 1.5 sec (step S48 in FIG. 5). As the result of studying various musical compositions, many cases have been found, in which FST-T is around 1 sec when FST is a dotted quarter note. Therefore, CPU 11 makes the above judgment at step S48. When it is determined YES at step S48, CPU 11 advances to step S49. When it is determined NO at step S48, CPU 11 advances to step S50. The above range of FST-T is not limited to the range from not less than 0.75 sec to less than 1.5 sec but other range, for example, a range from not less than 0.9 sec to less than 1.2 sec will be allowed, as far as it is judged whether FST-T is around 1 sec.

When it is determined YES at step S48, CPU 11 determines that the note corresponding to FST is a dotted quarter note and the tempo is 90 (step S49), finishing the process of beat/tempo calculation. The tempo of 90 means that there are 90 quarter notes per minute. In this case, the duration is ⅔ sec per quarter note. In the present embodiment, a tempo of "n" means that there are "n" pieces of quarter notes in one minute. This tempo is one example, and can be changed depending on the genre of musical compositions. It is also possible to employ an appropriate tempo, upon simulating various musical compositions.

When it is determined NO at step S48, CPU 11 judges whether FST-T is less than 0.75 sec (step S50). When it is determined YES at step S50, CPU 11 advances to step S51. When it is determined NO at step S50, CPU 11 advances to step S52.

When it is determined YES at step S50, that is, when it is determined that FST-T is less than 0.75 sec, CPU 11 determines that the note corresponding to FST is a dotted eighth note and the tempo is 90 (step S51), finishing the process of beat/tempo calculation.

When it is determined NO at step S50, that is, when it is determined that FST-T is not less than 0.75 sec, CPU 11 determines that the note corresponding to FST is a dotted half note and the tempo is 120 (step S52), finishing the process of beat/tempo calculation.

The tempo is an example, and can be changed depending on the genre of musical compositions. It is also possible to employ an appropriate tempo, upon simulating various musical compositions.

When it is determined at step S31 in FIG. 4 that FST-R+SST-R=1.33 is not true (NO at step S31), the following processes are performed.

When it is determined NO at step S31, CPU 11 judges whether FST-T is not less than 0.3 sec and less than 0.7 sec (step S32). As the result of studying various musical compositions, many cases have been found, in which FST-T is around 0.5 sec when FST is a quarter note or an eighth note. Therefore, CPU 11 makes the above judgment at step S32 in FIG. 4. When it is determined YES at step S32, CPU 11 determines that FST is a quarter note or an eighth note and advances to step S38 in FIG. 5. Meanwhile, when it is determined NO at step S32, CPU 11 determines that FST is a half note or a sixteenth note and advances to step S33.

When it is determined that FST is a half note or a sixteenth note (NO at step S32), CPU 11 judges whether FST-T is not less than 0.7 sec and less than 2.2 sec (step S33). When it is determined YES at step S33, CPU 11 advances to step S36 to determine that the note corresponding to FST is a half note and the tempo is 120, finishing the process of beat/tempo calculation. Meanwhile, when it is determined NO at step S33, CPU 11 advances to step S34.

In the process at step S34, CPU 11 judges whether FST-T is not less than 2.2 sec. When it is determined YES at step S34, CPU 11 determines that the note corresponding to FST is a whole note and the tempo is 120 (step S37), finishing the process of beat/tempo calculation. Meanwhile, when it is determined NO at step S34, CPU 11 advances to step S35 to determine that the note corresponding to FST is a sixteenth note and the tempo is 60.

In the process at step 61, CPU 11 judges whether pressing three consecutive notes (a group of three notes, triplet) is established. More precisely, it is judged whether it is true that FST is not larger than 0.33 sec (0.33 sec correspond to a duration of a group of three eighth notes in the tempo of 60), and SST is substantially equivalent to FST, and further the third ST is substantially equivalent to FST and SST. When it is determined YES at step S61, CPU 11 advances to step S62 to change the note corresponding to FST, set at step S35, to a group of three eighth notes, finishing the process of beat/tempo calculation.

Meanwhile, when it is determined NO at step S61, CPU 11 finishes the process of beat/tempo calculation.

When it is determined at step S32 that FST is a quarter note or an eighth note (YES at step S32), CPU 11 performs the processes at step S38 and at the following steps in FIG. 5, as follows. As the result of studying various musical compositions, with reference to the ratio of ST of the second entered performance information to ST of the first entered performance information (FST-R, SST-R) and FST-T, that is, the net time duration of FST (first entered note), CPU 11 judges whether the first entered note is a quarter note or an eighth note and determines how fast the tempo is.

At first, in the process at step S38, CPU 11 judges whether FST-R+SST-R=2 is true, that is, CPU 11 judges whether a duration of FST is substantially equivalent to a duration of SST.

When it is determined YES at step S38, that is, it is determined that FST-R+SST-R=2 is true (YES at step S38), CPU 11 judges whether FST-R: SST-R=1: 1 is true (step S40). This judgment of step S40 will be made, again, when it is determined NO at step S39, that is, when it is determined that FST-R+SST-R=3 is not true (NO at step S39).

When it is determined that FST-R: SST-R=1: 1 is true (YES at step S40), and when it is determined that FST-T is less than 0.55 sec (NO at step S41), then CPU 11 determines that the note corresponding to FST is an eighth note, and the tempo is 75 (step S42), finishing the process of beat/tempo calculation.

Meanwhile, when it is determined that FST-R: SST-R=1: 1 is not true (NO at step S40), CPU 11 advances to step 43. When it is determined that FST-T is not less than 0.55 sec (YES at step S41), CPU 11 advances to step S43, too. In the process at step S43, CPU 11 determines that the note corresponding to FST is a quarter note, and the tempo is 100, finishing the process of beat/tempo calculation.

When it is determined NO at step S38, that is, it is determined that FST-R+SST-R=2 is not true (NO at step S38), CPU 11 advances to step S39.

In the process at step S39, CPU 11 judges whether FST-R+SST-R=3 is true, that is, CPU 11 judges whether SST-R is equivalent to two times of FST-R in the case FST-R is set to 1. When it is determined at step S39 that FST-R+SST-R=3 is true (YES at step S39), CPU advances to step S44 and determines that the note corresponding to FST is an eighth note. In the process at step S45, CPU 11 judges whether FST-T is not less than 0.5 sec. When it is determined YES at step S45, CPU 11 advances to step S47 and determines that the tempo is 60, finishing the process of beat/tempo calculation. When it is determined NO at step S45, CPU 11 advances to step S46 and determines that the tempo is 75, finishing the process of beat/tempo calculation.

In the judgments made in the flow charts of FIG. 4 and FIG. 5, the numerical values employed as the references for judging the ratio of ST and the duration of ST are not limited to those described therein, but these numerical values can be changed depending on the genres of musical compositions and/or technical levels of the players.

Figure 6:
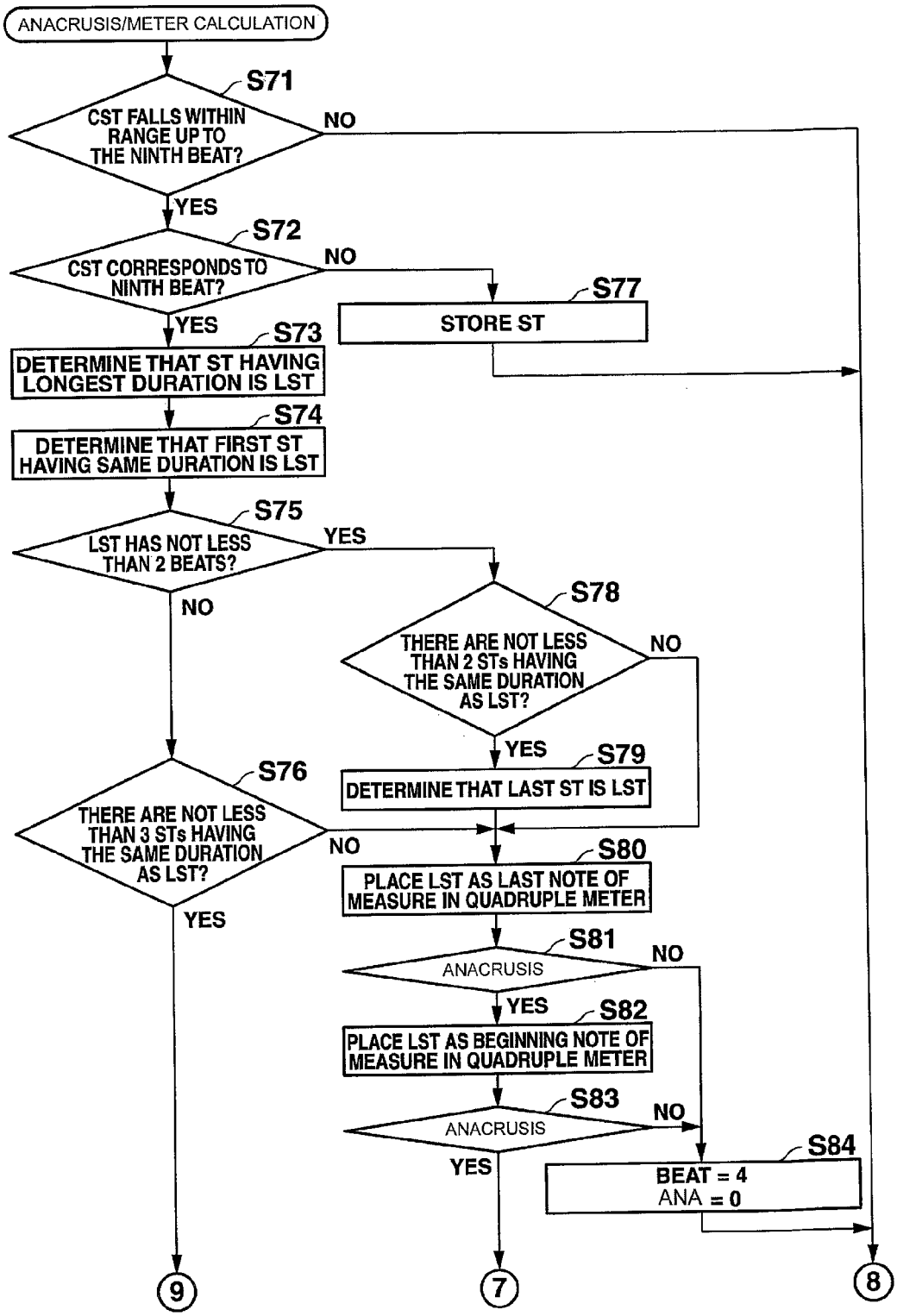
FIG. 6 to FIG. 8 are flow charts showing an example of a process of anacrusis/meter calculation performed in the electronic musical instrument, to which the performance-information processing apparatus according to the present embodiment is applied.
Figure 7:
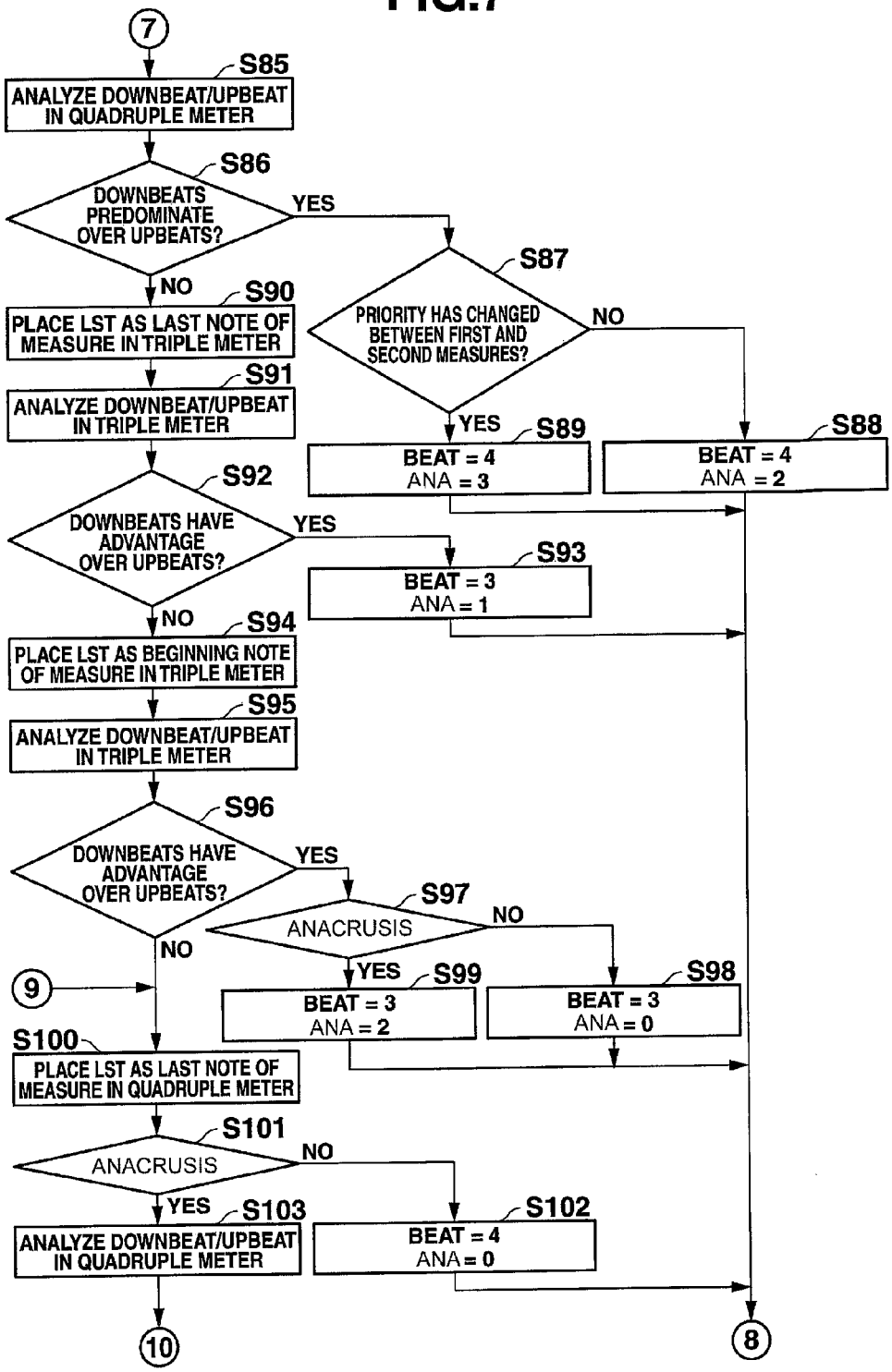
Figure 8:
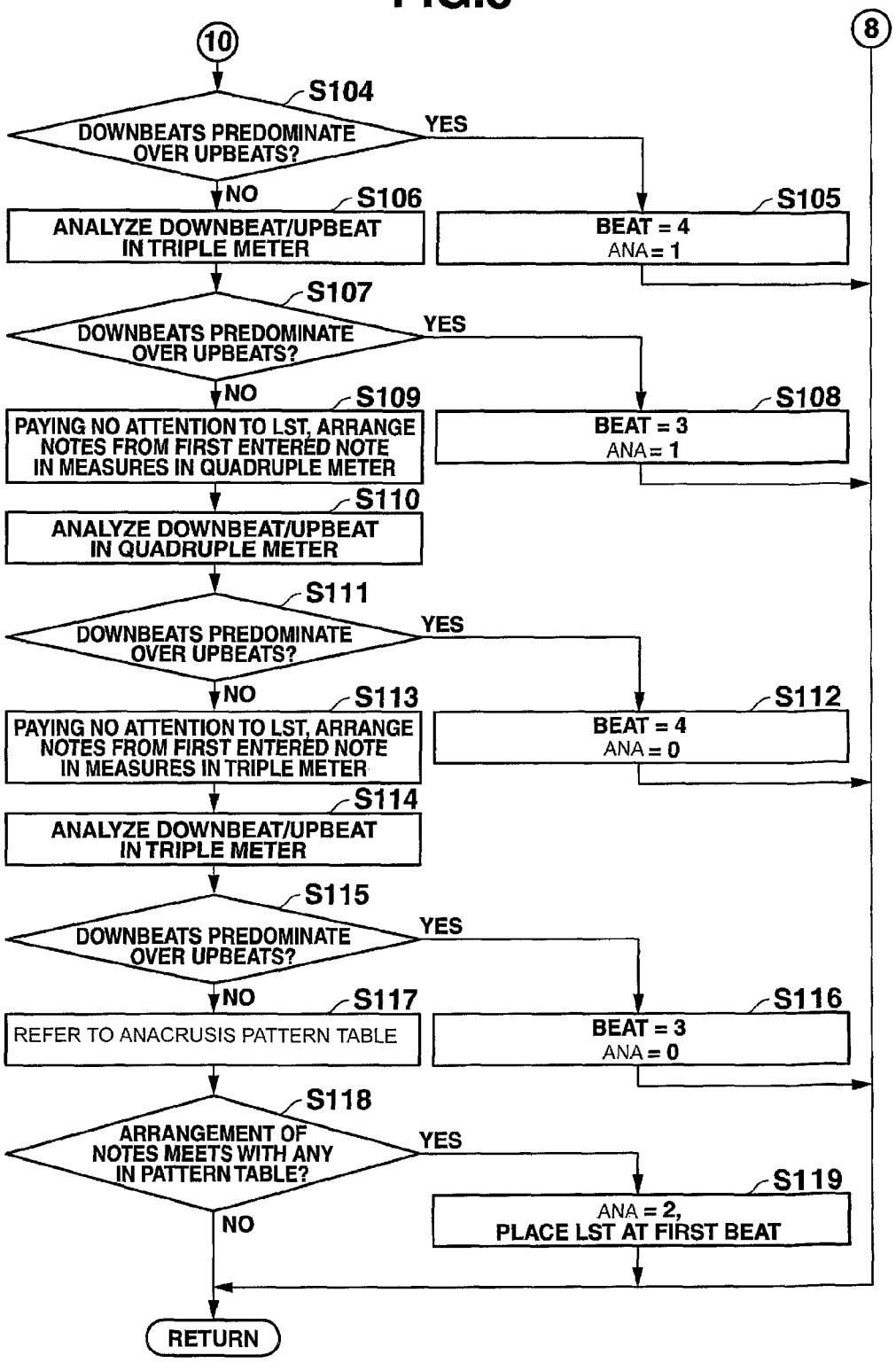

FIG. 6 to FIG. 8 are flow charts showing an example of a process of anacrusis/meter calculation performed in the electronic musical instrument 10, to which the performance-information processing apparatus according to the present embodiment is applied. In the process of anacrusis/meter calculation, CPU 11 determines a meter of a melody, and judges whether a melody has started at the beginning of the measure or the middle of the measure (anacrusis). In the present process, the first 8 beats are processed.

In the process at step S71 in FIG. 6, CPU 11 judges whether CST (Current Step Time), that is, ST of the currently entered performance information falls within a range up to the ninth beat. When it is determined YES at step S71, CPU 11 advances to step S72. When it is determined NO at step S71, that is, when it is determined that CST corresponds to the tenth beat or the greater beat (NO at step S71), CPU 11 finishes the process of anacrusis/meter calculation.

In the process at step S72, CPU 11 judges whether CST corresponds to the ninth beat. When it is determined YES at step S72, CPU 11 advances to step S73. In other words, when it is determined that CST is the first ST, which corresponds to the ninth beat in the processes at step S71 and step S72, then CPU 11 advances to step S73. When it is determined NO at step S72, that is, when it is determined that CST corresponds to any one of the first beat to the eighth beat (NO at step S72), CPU 11 advances to step S77.

In the process at step S77, CPU 11 stores ST in RAM 13, finishing the process of anacrusis/meter calculation. More particularly, when performing the process at step S77, CPU 11 stores in RAM 13 STs, which correspond respectively to the beats measured by such time. The beat at the time when the process at step S77 is performed, can be any one of the first beat to the eighth beat.

In the processes performed at step S71 to step S73, plural STs, which correspond respectively to the first beat to the eighth beat are stored in RAM 13 by the time when it has been determined YES at step S72. Therefore, STs, which correspond respectively to the first beat to the eighth beat will have been stored in RAM 13 at the time when the process has been performed at step S73.

In the present embodiment, STs corresponding respectively to the first beat to the eighth beat are to be processed in the process of anacrusis/meter calculation but STs to be processed are not limited to these STs corresponding to the first beat to the eighth beat but it is possible to process STs, which correspond to other beats.

In the process at step S73, CPU 11 determines that ST having the longest duration among STs corresponding to the first to the eighth beat is LST. For instance, in an example 1 of a score shown in FIG. 11, either of half notes will be a candidate for LST.

In the process at step S74, in the case where there are plural notes of the same duration in a score, CPU 11 determines that the first note is LST. For instance, in the example 1 of a score, the first half note is LST. In the process at step S74, the "same duration" does not always mean the "exactly same duration", but also means the "substantially same duration", which includes errors due to fluctuation in the player's performance. Even if plural notes have durations slightly different from the others, these notes will be regarded as having the same duration. Further, it is possible to appropriately quantize performance-information to be entered.

In the process at step S75, CPU 11 judges whether LST has a duration of not less than 2 beats. When it is determined YES at step S75, CPU 11 advances to step S78. For instance, in the example 1 of a score shown in FIG. 11, the first half note is LST, and therefore LST has a duration of not less than 2 beats. Accordingly, in the case of the example 1 of score, CPU 11 advances to step S78, and judges whether there are not less than two STs having the same duration as LST. For instance, in the example 1 of a score shown in FIG. 11, there are two half notes and therefore CPU 11 determines YES at step S78 and advances to step S79. In the process at step S79, CPU 11 determines that the last ST (note) out of not less than two STs (notes) having the same duration as the above LST is LST. In the example 1 of a score, it is determined that the last (second) half note is LST (step S79). Then, CPU 11 advances to step S80.

When it is determined NO at step S78, that is, when there is one ST (note) having the same duration as LST (when ST (note) having the same duration as LST is the LST itself) (NO at step S78), CPU 11 advances to step S80. In the process at step S78, a note having a duration a little different from the "same duration" is regarded as the note having the "same duration". The "same duration" will be applied in the following description.

When it is determined at step S75 that LST has not a duration of not less than 2 beats (NO at step S75), and when it is determined at step S76 that there are less than three STs having the same duration as LST (NO at step S76), CPU 11 advances to step S80.

In the process at step S75, it is possible to judge whether LST has a duration of not less than 3 beats in place of a duration of not less than 2 beats. The conditions for judgment can be changed depending on the genre of musical compositions.

In the process at step S80, CPU 11 places ST of 8 beats as LST, that is, as the last note of a measure in quadruple meter, and then advances to step S81 to judge whether an anacrusis occurs. More precisely, in the present embodiment when a group of notes to be processed spreads out of two measures or when the group of notes to be processed does not saturate two measures, then it is determined that an anacrusis occurs. When it is determined NO at step S81, CPU 11 advances to step S84.

In the process at step S84, CPU 11 determines that no anacrusis occurs (the anacrusis flag is set to 0) and a quadruple meter has been set in the measures (Beat flag is set to 4). Particularly, refer to an example 2 of a score, shown in FIG. 11.

In the process at step S80, on the assumption that the note of LST is placed as the last note in the measure in quadruple meter, when a group of notes is placed just in two measures, CPU 11 determines at step S81 that no anacrusis occurs (NO at step S81), and advances to step S84. This means that CPU 11 determines that the group of notes has been correctly placed in the measures and temporarily determines that no anacrusis occurs (the anacrusis flag is set to 0) and quadruple meter has been set in the measures (Beat flag is set to 4).

Figures 11, 12:
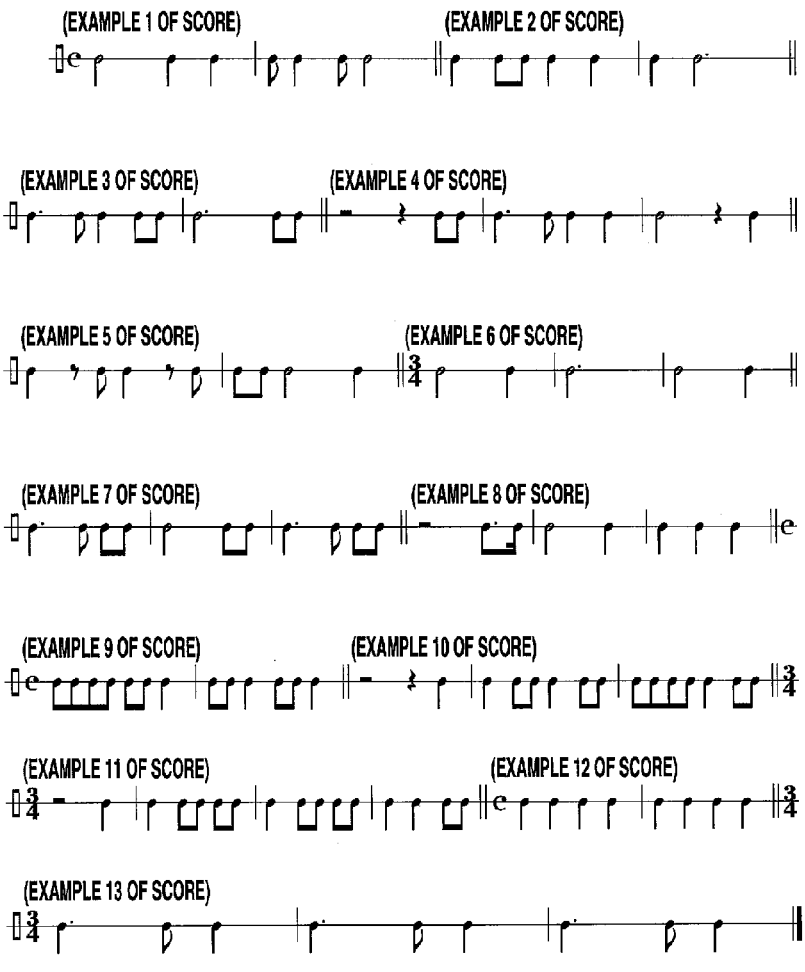
FIG. 11 is a view showing examples of scores used for explaining the present embodiment of the invention.
FIG. 12 is a view showing an example of an anacrusis pattern table used in the present embodiment of the invention.

The example 2 of a score shown in FIG. 11 is referred to. In the example 2 of a score, LST is a dotted half note written at the end of the two measures. Therefore, it is assumed that the measures in quadruple meter are delimited at a location corresponding to the time when the duration of the dotted half note ceases, and other notes are placed in quadruple meter. Then, in the example 2 of a score it will be understood that notes corresponding respectively to the first beat to the eighth beat will be just placed out in the measures in quadruple meter. Therefore, in this case CPU 11 determines that notes are placed correctly, and determines at step S81 that no anacrusis occurs, performing the process at step S84 and determines that no anacrusis occurs (the anacrusis flag is set to 0) and the quadruple meter has been set (Beat flag is set to 4).

An anacrusis flag will be described hereinafter. When the anacrusis flag is set to 0, no anacrusis occurs. When the anacrusis flag is set to 1, LST is the note placed at the end of the measure and an anacrusis occurs. When the anacrusis flag is set to 2, LST is the note placed at the beginning of the measure and an anacrusis occurs, and when the anacrusis flag is set to 3, no anacrusis occurs but such an underlying anacrusis occurs that the last note of a phrase is not the last note of the measure.

The Beat flag indicates the meter set in the measures. When Beat flag is set to 4, the quadruple meter is set, and when Beat flag is set to 3, the triple meter is set.

When it is determined YES at step S81, that is, when it is determined that, when LST, that is, ST of 8 beats is placed as the last note in the measure in quadruple meter, an anacrusis occurs (YES at step S81), CPU 11 advances to step S82, and places LST, that is, ST of 8 beat as the beginning note in the measure in quadruple meter. Then, CPU 11 advances to step S83 and judges whether anacrusis occurs. When it is determined YES at step S83, CPU 11 advances to step S85 in FIG. 7. When it is determined NO at step S81, CPU 11 advances to step S84. The process to be performed at step S84 following to the process at step S83 will be described specifically, referring to an example 3 of a score shown in FIG. 11.

In the example 3 of a score, LST is a dotted half note, and therefore it is determined YES at step S75 in FIG. 7. In the process at step S78, it is determined NO, because there is no ST having the same duration as LST. When LST or a dotted half note is placed as the last note of the measure in quadruple meter, 3 beats from the beginning overflow and it is determined that an anacrusis occurs. As a result, CPU 11 determines YES at step S81. Further, when LST or a dotted half note is placed as the beginning note of the measure in quadruple meter, no anacrusis occurs and then CPU 11 determines NO at step S83, advancing to the process at step S84 to determine that no anacrusis occurs (the anacrusis flag is set to 0) and the quadruple meter is set (Beat flag is set to 4).

In the process at step S85 in FIG. 7, CPU 11 analyzes a downbeat/upbeat in quadruple meter. More particularly, in the process at step S85 CPU 11 analyzes the downbeat/upbeat in quadruple meter with LST, that is, ST (note) of 8 beats placed as the beginning note of the measure in quadruple meter in the process at step S82. In the process of analyzing downbeat/upbeat at step S85, CPU 11 gives points respectively to downbeats and upbeats. In the quadruple meter, the first beat and the third beat are downbeats and the other beats are upbeats. The points to be given to these beats are determined depending on the durations of notes corresponding to said beats. For instance, the point of 1 is given to an eighth note, the point of 2 to a quarter note, the point of 3 to a dotted quarter note, and the point of 4 to a half note. The longer the duration of note, the larger the point set to be given to the note. For instance, in the example 1 of a score in FIG. 11, the total point given to the downbeats will be 4+2+1+4=11, and the total point given to the upbeats will be 2+2+1=5. The total point given to the downbeats is larger than the total point given to the upbeats, and therefore CPU 11 determines that the downbeats have an advantage over the upbeats.

In the process at step S86, depending on the result of analyzing the downbeat/upbeat at step S85, CPU 11 judges whether the downbeats predominate in the total point over the upbeats. When it is determined YES at step S86, CPU 11 advances to step S87. When it is determined NO at step S86, CPU 11 advances to step S90.

In the process at step S87, CPU 11 judges whether the priority has changed between the first measure and the second measure. In other words, if the downbeats predominate over the upbeats in the first measure, then it is judged whether the downbeats still predominate over the upbeats in the second measure, too. For instance, in an example 5 of score in FIG. 11, the total point to the downbeats will be 2+2=4 and the total point to the upbeats will be 1+1=2 in the first measure, and therefore the downbeats predominate over the upbeats in the first measure. On the contrary, in the second measure, the total point to the downbeats will be 1 and the total point to the upbeats will be 1+4+2=7, and then the downbeats do not predominate over the upbeats in the second measure. Therefore, in this case CPU 11 determines that the priority has changed between the first measure and the second measure. When it is determines YES at step S87, CPU 11 advances to step S89, and sets the anacrusis flag to 3 and Beat flag to 4, finishing the process of anacrusis/meter calculation. When it is determines NO at step S87, CPU 11 advances to step S88, and sets the anacrusis flag to 2 and Beat flag to 4 (which corresponds to an example 4 of a score in FIG. 11), finishing the process of anacrusis/meter calculation.

In the process at step S90, or when it is determined at step S86 depending on the result of the process of analyzing downbeat/upbeat, that the downbeats do not predominate over the upbeats, CPU 11 places LST, that is, ST (note) of 8 beats as the last note of the measure in triple meter. For instance, in an example 6 of a score in FIG. 11, since it is determined that a dotted half note in the second measure is LST, on the assumption that the dotted half note is the last note of the measure in triple meter, CPU 11 places other note.

In the process at step S91, CPU 11 analyzes a downbeat/upbeat in triple meter. More particularly, in the process at step S91 CPU 11 analyzes the downbeat/upbeat in triple meter with LST, that is, ST (note) of 8 beats placed as the last note of the measure in triple meter in the process at step S90. Also in the process of analyzing downbeat/upbeat at step S91, CPU 11 gives points respectively to downbeats and upbeats. In triple meter, the first beat is a downbeat, and the other beats are upbeats. The points to be given to the beats are determined depending on the durations of notes corresponding to said beats. For instance, the point of 1 is given to an eighth note, the point of 2 to a quarter note, the point of 3 to a dotted quarter note, and the point of 4 to a half note. The longer the duration of note, the larger the point set to be given to the note. For instance, in the range up to the eighth beat (up to the second beat in the third measure) in the example 6 of a score in FIG. 11, the total point given to the downbeats will be 4+6+4=14, and the total point given to the upbeats will be 2+0+0=2. The total point given to the downbeats is larger than the total point given to the upbeats, and therefore CPU 11 determines that the downbeats have an advantage over the upbeats.

In the process at step S92, CPU 11 judges whether the downbeats have an advantage over the upbeats, as the result of analyzing the downbeat/upbeat at step S91, that is, CPU 11 judges whether the total point given to the downbeat is larger than the total point given to the upbeats. When it is determined YES at step S92, CPU 11 advances to step S93 and sets the anacrusis flag to 1 and Beat flag to 3, finishing the process of anacrusis/meter calculation. When it is determined NO at step S92, CPU 11 advances to step S94.

In the process at step S94, CPU 11 places LST, that is, ST (note) of 8 beats as the beginning note of the measure in triple meter. For instance, in the examples 7 and 8 of a score in FIG. 11, since it is determined in the both examples 7 and 8 that the half note at the first beat in the second measure is LST, on the assumption that the half note is the beginning note in the measure in triple meter, CPU 11 places other note.

In the process at step S95, CPU 11 analyzes the downbeat/upbeat in triple meter. More particularly, in the process at step S95 CPU 11 analyzes the downbeat/upbeat in triple meter with LST, that is, ST (note) of 8 beats placed as the beginning note of the measure in triple meter in the process at step S94. The process at step S95 is performed in substantially the same manner as the process at step S91.

In the process at step S96, CPU 11 judges whether the downbeats have an advantage over the upbeats, as the result of analyzing downbeat/upbeat at step S95, that is, CPU 11 judges whether the total point given to the downbeat is larger than the total point given to the upbeats. When it is determined YES at step S96, CPU 11 advances to step S97. When it is determined NO at step S96, CPU 11 advances to step S100.

In the process at step S97, CPU 11 judges whether anacrusis occurs. This judgment is made with LST placed as the beginning note of the measure in triple meter in the process at step S94. When it is determined YES at step S97, CPU 11 advances to step S99 and sets the anacrusis flag to 2 and Beat flag to 3 (which corresponds to an example 8 of a score in FIG. 11), finishing the process of anacrusis/meter calculation. Meanwhile, when it is determined NO at step S97, CPU 11 advances to step S98 and sets the anacrusis flag to 0 and Beat flag to 3 (which corresponds to an example 7 of a score in FIG. 11), finishing the process of anacrusis/meter calculation.

When it is determined at step S96 that the downbeats have no advantage over the upbeats (NO at step S96), or when it is determined at step S76 that there are not less than three STs having the same duration as LST (YES at step S76) (for instance, in an example 9 of a score shown in FIG. 11, since LST is the first quarter note and there are two additional quarter notes, there are three STs having the same duration as LST), CPU 11 advances to step S100.

In the process at step S100, CPU 11 places LST, that is, ST (note) of 8 beats as the last note of the measure in quadruple meter, and judges at step S101 whether anacrusis occurs. When it is determined NO at step S101, CPU 11 advances to step S102 to set the anacrusis flag to 0 and Beat flag to 4 (which corresponds to the example 9 of a score in FIG. 11), finishing the process of anacrusis/meter calculation. Meanwhile, when it is determined YES at step S101, CPU 11 advances to step S103.

In the process at step S103, CPU 11 analyzes the downbeat/upbeat in quadruple meter (similar process to the process at step S85). More particularly, with LST, that is, ST (note) of 8 beats placed as the last note of the measure in quadruple meter in the process at step S100, CPU 11 analyzes the downbeat/upbeat in quadruple meter at step S103. In the process at step S104 in FIG. 8, depending on the result of analyzing the downbeat/upbeat in quadruple meter at step S103, CPU 11 judges whether the downbeats predominate over the upbeats. When it is determined YES at step S104, CPU 11 advances to step S105 to set the anacrusis flag to 1 and Beat flag to 4 (which corresponds to an example 10 of a score in FIG. 11), finishing the process of anacrusis/meter calculation. Meanwhile, when it is determined NO at step S104, CPU 11 advances to step S106.

In the process at step S106, CPU 11 analyzes the downbeat/upbeat in triple meter (similar process to the process at step S91). More particularly, in the process at step S106 CPU 11 analyzes the downbeat/upbeat in triple meter with LST, that is, ST (note) of 8 beats placed as the last note of the measure in quadruple meter in the process at step S100. In the process at step S107 in FIG. 8, depending on the result of analyzing the downbeat/upbeat in triple meter at step S106, CPU 11 judges whether the downbeats predominate over the upbeats. When it is determined YES at step S107, CPU 11 advances to step S108 to set the anacrusis flag to 1 and Beat flag to 3 (which corresponds to an example 11 of a score in FIG. 11), finishing the process of anacrusis/meter calculation. Meanwhile, when it is determined NO at step S107, CPU 11 advances to step S109.

In the process at step S109, without paying attention to LST, CPU 11 sequentially arranges notes from the first entered note in the first measure in quadruple meter.

In the process at step S110, CPU 11 analyzes the downbeat/upbeat in quadruple meter (similar process to the process at step S85). In the process at step S111, CPU 11 judges whether the downbeats predominate over the upbeats. When it is determined YES at step S111, CPU 11 advances to step S112 to set the anacrusis flag to 0 and Beat flag to 4 (which corresponds to an example 12 of a score in FIG. 11), finishing the process of anacrusis/meter calculation. Meanwhile, when it is determined NO at step S111, CPU 11 advances to step S113.

In the process at step S113, without paying attention to LST, CPU 11 sequentially arranges notes from the first entered note in the first measure in triple meter. In the process at step S114, CPU 11 analyzes the downbeat/upbeat in triple meter. In the process at step S115, CPU 11 judges whether the downbeats predominate over the upbeats. When it is determined YES at step S115, CPU 11 advances to step S116 to set the anacrusis flag to 0 and Beat flag to 3 (which corresponds to an example 13 of a score in FIG. 11), finishing the process of anacrusis/meter calculation. Meanwhile, when it is determined NO at step S115, CPU 11 advances to step S117.

In the process at step S117, an anacrusis pattern table shown in FIG. 12 is referred to. FIG. 12 is a view showing an example of the anacrusis pattern table, which stores plural sorts of arrangement patterns of notes, in which anacrusis occurs. Examples of patterns of rhythm are shown in FIG. 12, in which anacrusis occurs. In the patterns of rhythm, notes of a relatively short duration are placed at upbeats and then notes of a relatively long duration are placed at downbeats.

In the process at step S118, referring to the anacrusis pattern table, CPU 11 judges whether an arrangement of notes, containing the beginning note, meets with any of patterns stored in the anacrusis pattern table. When it is determined YES at step S118, CPU 11 advances to step S119 to set the anacrusis flag to 2 and place LST at the first beat. Meanwhile, when it is determined NO at step S118, CPU 11 finishes the process of anacrusis/meter calculation.

Figure 9:
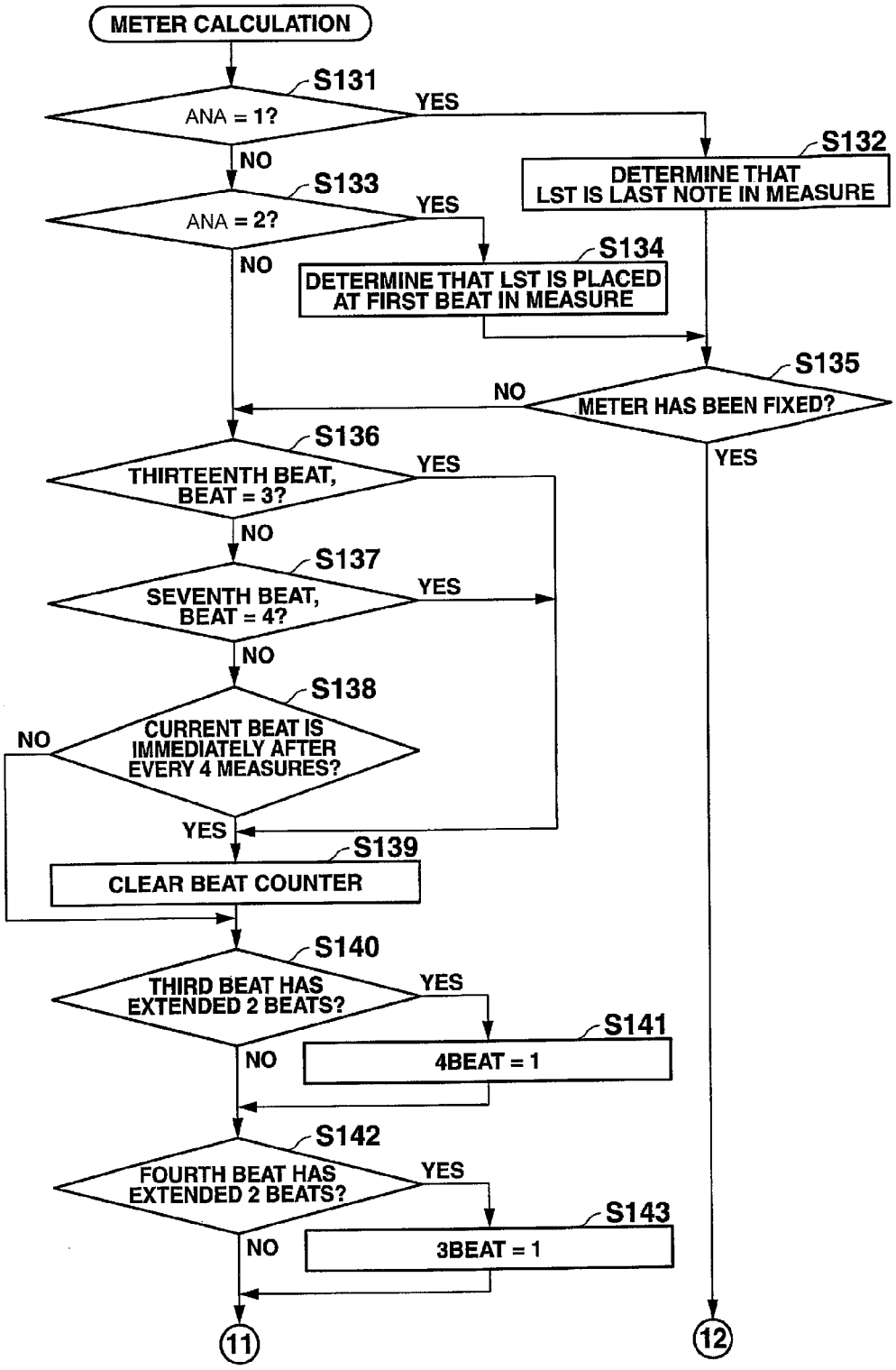
FIG. 9 and FIG. 10 are flow charts showing an example of a process of meter calculation performed in the electronic musical instrument, to which the performance-information processing apparatus according to the present embodiment is applied.
Figure 10:
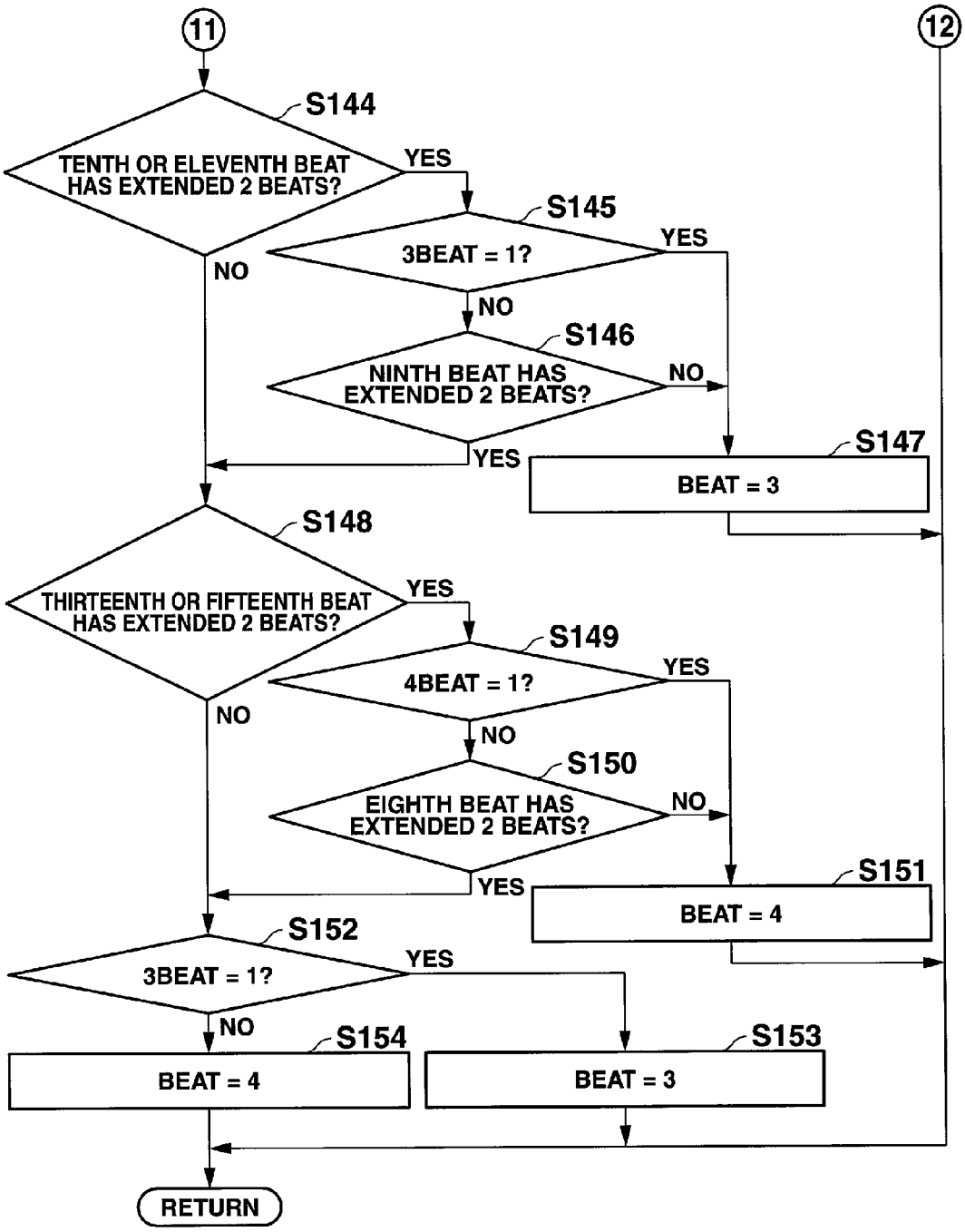

FIG. 9 and FIG. 10 are flow charts showing an example of a process of meter calculation performed in the electronic musical instrument 10, to which the performance-information processing apparatus according to the present embodiment is applied.

In the process at step S131 in FIG. 9, CPU 11 judges whether the anacrusis flag has been set to 1. When it is determined that the anacrusis flag has been set to 1 (YES at step S131), that is, when LST is the last note in the measure and anacrusis occurs (YES at step S131), CPU 11 advances to step S132 and determines that LST is the last note in the measure. Then, CPU 11 advances to step S135. Meanwhile, when it is determined NO at step S131, CPU 11 advances to step S133.

In the process at step S133, CPU 11 judges whether the anacrusis flag has been set to 2. When it is determined that the anacrusis flag has been set to 2 (YES at step S133), that is, when LST is the beginning note in the measure and an anacrusis occurs, CPU 11 advances to step S134 and determines that LST is placed at the first beat in the measure. Then, CPU 11 advances to step S135. Meanwhile, when it is determined NO at step S133, CPU 11 advances to step S136.

In the process at step S135, CPU 11 judges whether meter has been fixed. More specifically, when Beat flag has been kept to the initial value (for instance, "0"), CPU 11 determines that the meter has not been fixed. Meanwhile, when Beat flag has been to a value, CPU 11 determines that the meter has been fixed. When it is determined YES at step S135, CPU 11 finishes the process of meter calculation. When it is determined NO at step S135, CPU 11 advances to step S136.

When the anacrusis flag has been set neither to 1 nor to 2 (NO at step S131 and NO at step S133), or when it is determined at step S135 that the meter has not been fixed (NO at step S135), CPU 11 performs the process at step S136.

In the process at step S136, CPU 11 judges whether the current beat is the thirteenth beat in triple meter. The thirteenth beat is a beat directly following the fourth measure in triple meter. When it is determined YES at step S136, CPU 11 advances to step S139. When it is determined NO at step S136, CPU 11 advances to step S137.

In the process at step S137, CPU 11 judges whether the current beat is the seventeenth beat in quadruple meter. The seventeenth beat is a beat directly following the fourth measure in quadruple meter. When it is determined YES at step S137, CPU 11 advances to step S139. When it is determined NO at step S137, CPU 11 advances to step S138.

In the process at step S138, CPU 11 judges whether the current beat is the beat following immediately after every interval of 4 measures. In other words, in the case of triple meter (Beat=3), CPU 11 judges whether the current beat is the (12×n+1)-th beat, and in the case of quadruple meter (Beat=4), CPU 11 judges whether the current beat is the (16×n+1)-th beat, where n is an integer of not less than 0. When it is determined YES at step S138, CPU 11 advances to step S139. When it is determined NO at step S138, CPU 11 advances to step S140.

In the process at step S139, CPU 11 clears a beat counter for studying meter.

In the process at step S140, CPU 11 judges whether the third beat has extended 2 beats. When it is determined YES at step S140, CPU 11 advances to step S141 and sets 4-Beat flag to 1. The 4-Beat flag indicates that the measures are potentially set in quadruple meter. When the 4-Beat flag is set to 1, the measures are potentially set in quadruple meter. More particularly, the third beat is an upbeat in triple meter, and it is rare that this third beat extends 2 beats to reach the first beat (downbeat) in the following measure. Meanwhile, a melody is frequently used, in which the third beat in quadruple meter extends by 2 beats. Therefore, in this case, "4-Beat=1" is stored, which indicates that apiece is likely in quadruple meter.

Meanwhile, when it is determined NO at step S140, CPU 11 advances to step S142.

In the process at step S142, CPU 11 judges whether the fourth beat has extended 2 beats. When it is determined YES at step S142, CPU 11 advances to step S143 to set 3-Beat flag to 1. The 3-Beat flag is a flag, which indicates that triple meter is potentially set. When the 3-Beat flag is set to 1, triple meter is potentially set. More particularly, the fourth beat is an upbeat in quadruple meter, and it is rare that this fourth beat extends 2 beats to reach the first beat (downbeat) in the following measure. Meanwhile, a melody is frequently used, in which the fourth beat extends 2 beats, since said fourth beat is the beginning beat of a measure in triple meter. Therefore, in this case, "3-Beat=1" is stored, which indicates that a tune is likely in triple meter.

Meanwhile, when it is determined NO at step S142, CPU 11 advances to step S144 in FIG. 10.

In the process at step S144, CPU 11 judges whether the tenth beat or the eleventh beat has extended not less than 2 beats. When it is determined YES at step S144, CPU 11 advances to step S145. When it is determined NO at step S144, CPU 11 advances to step S148.

In the process at step S145, CPU 11 judges whether the 3-Beat flag has been set to 1. When it is determined YES at step S145, CPU 11 advances to step S147 to set Beat flag to 3 and determines that triple meter is set, finishing the process of meter calculation. Meanwhile, when it is determined NO at step S145, CPU 11 advances to step S146.

In the process at step S146, CPU 11 judges whether the ninth beat has extended not less than 2 beats. When it is determined YES at step S146, CPU 11 advances to step S148. When it is determined NO at step S146, CPU 11 advances to step S147 to set Beat flag to 3 and determines that triple meter is set, finishing the process of meter calculation. In other words, since the ninth beat is the last upbeat in the measure in triple meter, if the ninth beat does not extend not less than 2 beats, it is determined that triple meter has been set.

In the process at step S148, CPU 11 judges whether the thirteenth beat or the fifteenth beat extends not less than 2 beats. When it is determined YES at step S148, CPU 11 advances to step S149. When it is determined NO at step S148, CPU 11 advances to step S152.

In the process at step S149, CPU 11 judges whether the 4-Beat flag has been set to 1. When it is determined YES at step S149, CPU 11 advances to step S151 to set Beat flag to 4 and determines that quadruple meter is set, finishing the process of meter calculation. Meanwhile, when it is determined NO at step S149, CPU 11 advances to step S150.

In the process at step S150, CPU 11 judges whether the eighth beat has extended not less than 2 beats. When it is determined YES at step S150, CPU 11 advances to step S152. When it is determined NO at step S150, CPU 11 advances to step S151 to set Beat flag to 4 and determines that quadruple meter is set, finishing the process of meter calculation. In other words, since the eighth beat is the last upbeat in the measure in quadruple meter, if the eighth beat does not extend less than 2 beats, it is determined that triple meter has been set.

In the process at step S152, CPU 11 judges whether the 3-Beat flag has been set to 1. When it is determined YES at step S152, CPU 11 advances to step S153 to set Beat flag to 3 and determines that triple meter is set, finishing the process of meter calculation. Meanwhile, when it is determined NO at step S152, CPU 11 advances to step S154 to set Beat flag to 4 and determines that quadruple meter is set, finishing the process of meter calculation.

CPU 11 mounted on the electronic musical instrument according to the present embodiment of the invention sequentially obtains entered performance information, and judges whether the performance information has been entered, corresponding to a time interval from a time, at which the performance information starts entering to a first predetermined time (for instance, the time when the third performance information is entered). When it is determined that the performance information corresponding to the time interval from the time, at which the performance information starts entering to the first predetermined time has been entered, CPU 11 determines a tempo of the performance information based on the performance information corresponding to the time interval from the time, at which the performance information starts entering to the first predetermined time, and further determines meter of the performance information based on the determined tempo of the performance information.

In the present embodiment of the invention, CPU 11 judges whether the performance information has been entered, corresponding to a time interval from the time, at which the performance information starts entering to a second predetermined time (for instance, the time corresponding to the ninth beat). When it is determined that the performance information corresponding to the time interval from the time, at which the performance information starts entering to the second predetermined time has been entered, CPU 11 determines a tempo of the performance information based on the performance information corresponding to the time interval from the time, at which the performance information starts entering to the second predetermined time, and further determines meter of the performance information based on the determined tempo of the performance information.

In the present embodiment of the invention, CPU 11 calculates SST-R, that is, a ratio of SST to FST, and determines the tempo based on FST-T and SST-R, wherein FST is a duration or a tone value of the first entered performance information and SST is a duration or a tone value of the second entered performance information.

In the present embodiment of the invention, CPU 11 judges based on the determined tempo of the performance information, whether a time interval corresponding to the predetermined number of beats (for instance, 8 beats) has lapsed from the time, at which the performance information starts entering. When it is determined that the time interval corresponding to the predetermined number of beats has lapsed from the time, at which the performance information starts entering, CPU 11 determines a meter of the performance information.

In the present embodiment of the invention, CPU 11 studies al least one piece of performance information among plural pieces of performance information entered at the third, fourth, eighth, and ninth beats on the basis of the time, at which the performance information starts entering to determine a meter of the performance information.

In the present embodiment of the invention, CPU 11 selects the performance information having the longest duration from among the plural pieces of performance information corresponding to a time interval from the time, at which the performance information starts entering to a third predetermined timing (for instance, the time corresponding to the eighth beat), and determines a meter in accordance with the timing of the selected performance information (for instance, LST) having the longest duration.

In the present embodiment of the invention, CPU 11 judges whether an anacrusis occurs in the entered performance information. When it is determined that an anacrusis occurs in the entered performance information, CPU 11 determines meter of the performance information using the input timing of the performance information (LST) selected as having the longest duration as the reference timing.

In the present embodiment of the invention, CPU 11 compares the performance information entered at the time when a time interval corresponding to the first group of beats (for instance, 3 beats and 4 beats) has lapsed from the time, at which the performance information starts entering with the performance information entered at the time when a time interval corresponding to the second group of beats (for instance, 8 beats and 9 beats) has lapsed from the time, at which the performance information starts entering, thereby determining a meter of the performance information.

In the present embodiment of the invention, CPU 11 judges depending on a duration of FST-T, whether the tempo of the performance information is faster than the tempo of the entered performance information.

The performance-information processing apparatus according to the present embodiment has a table used by CPU 11 for outputting a value of tempo based on FST-T and SST-R.

In the present embodiment of the invention, CPU 11 judges whether the performance information has been entered, corresponding to a time interval from the time, at which the performance information starts entering to a fourth predetermined timing (for instance, the time corresponding to (a multiple of 12+1) of beats or (a multiple of 16+1) of beats). When it is determined that the performance information has been entered, corresponding to the time interval from the time, at which the performance information starts entering to the fourth predetermined timing, CPU 11 determines the tempo and meter again, regarding the forth predetermined timing as a new time, at which the performance information starts entering again.

The present invention is not limited to the particular embodiments described herein, but various modifications may be made to the disclosed embodiments while remaining within the scope of the invention as defined by the following claims. It is intended to include all such modifications in the following claims.

In the present description, steps describing a program written on a recording medium contain not only processes, which are performed in a time series manner, but also processes, which are performed in parallel or separately. Further, in the present description, the terms concerning the system mean whole equipment comprising plural apparatuses, units and means.

Although specific embodiments of the invention have been described in the foregoing detailed description, it will be understood that the description of the embodiments has been presented only for purposes of illustration and description, and does not restrict the technical scope of the invention described herein. Persons skilled in the art may make various changes in the shape, size and arrangement of parts. For example, persons skilled in the art may substitute equivalent elements for the elements illustrated and described herein. The modifications and rearrangements may be made to the disclosed embodiments while remaining within the scope of the invention as defined by the following claims. It is intended to include all such modifications in the following claims and their equivalents.

In the present embodiment of the invention, CPU 11 performs the process of beat/tempo calculation, which has been described with reference to the flow charts shown in FIG. 4 and FIG. 5. But without performing the process of beat/tempo calculation, it is possible for CPU 11 to determine the tempo by referring to a table shown in FIG. 13 in accordance with FST-T and SST-R. The table is prepared for determining tempos. In this case, for instance, when FST-T is 0.5 and SST-R is 1, then the tempo will be 75. Using the table, without calculating complicated formulas, more precise judgment will be made and the process can be performed faster.

Figure 13:
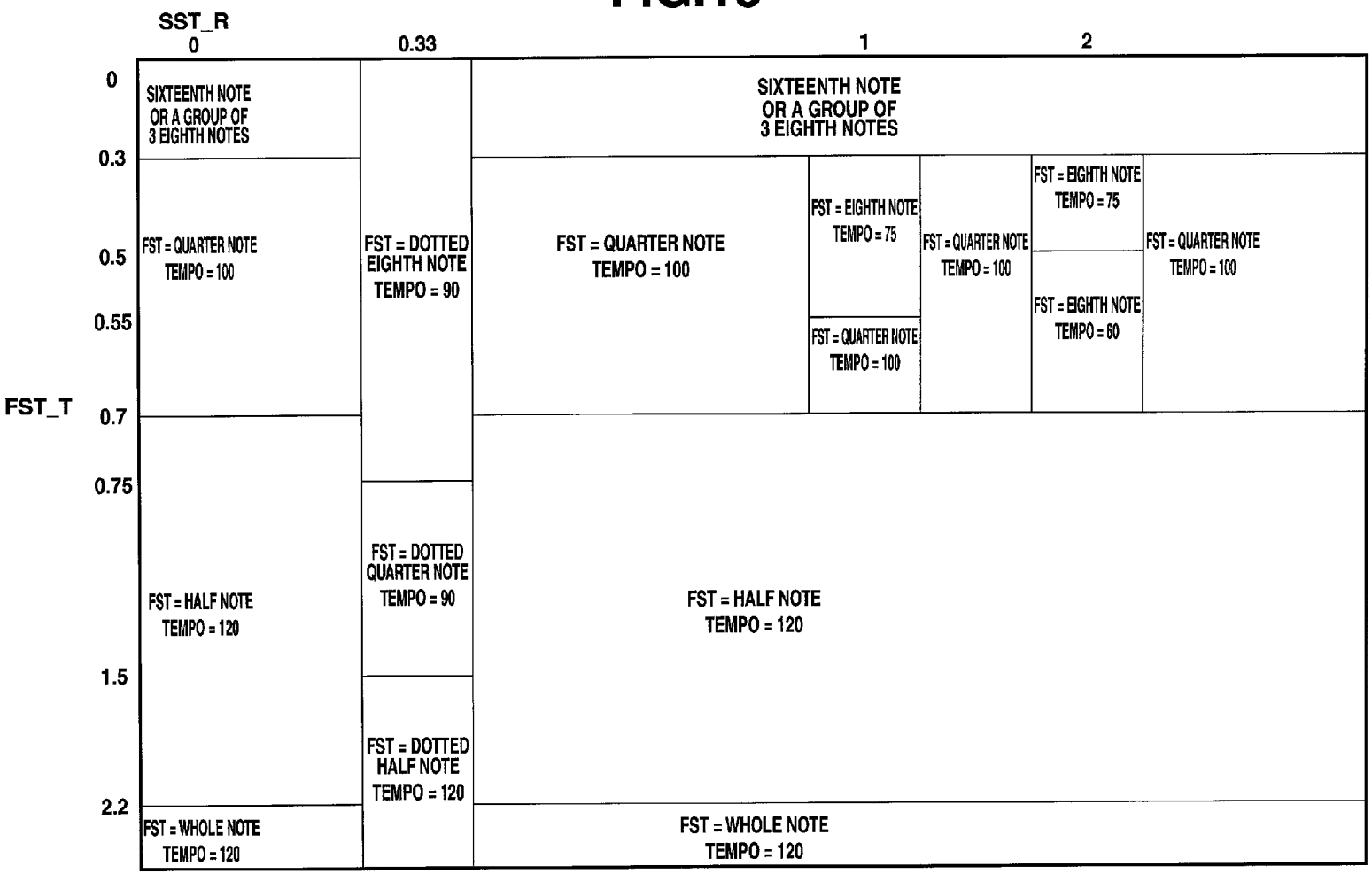
FIG. 13 is a view showing an example of a table for determining a tempo used in the present embodiment of the invention.

In the table shown in FIG. 13, SST-R is plotted along the abscissa axis but it is possible to plot SST-T along the abscissa axis.

In the present embodiment of the invention, the process of beat/tempo calculation shown in FIG. 4 and FIG. 5, the process of anacrusis/meter calculation shown in FIG. 6 to FIG. 8, and the process of meter calculation shown in FIG. 9 and FIG. 10 are examples of the respective processes, and it is possible to change the order of judgment to be made therein, and to appropriately change values to be selected or compared. Further, the processes of various calculations can be changed depending on the genre of musical compositions. For instance, it is possible to arrange the electronic musical instrument 10 so as to provide the switch group 15 with a switch for selecting the genre of musical compositions and to allow the user to operate such switch to select his/her desired genre of music, wherein a process routine appropriate for the selected genre of music is performed.

What is claimed is:

1. A performance-information processing apparatus comprising:

a tempo determining unit which determines a tempo of performance information, based on the performance information entered in a time interval between (i) a starting time point, at which one note out of at least two notes in the performance information starts entering and (ii) a first timing, that is a certain time after another note has been entered after said one note was entered; and a meter determining unit which determines a meter of the performance information based on the tempo determined by the tempo determining unit, wherein the meter determining unit determines a meter of the performance information, based on the performance information entered in a time interval between (i) the starting time point, at which said one note out of at least the two notes in the performance information starts entering and (ii) a second timing, which is determined based on the tempo determined by the tempo determining unit.

2. A performance-information processing apparatus comprising:

a tempo determining unit which determines a tempo of performance information, based on the performance information entered in a time interval between (i) a starting time point, at which one note out of at least two notes in the performance information starts entering and (ii) a first timing, that is a certain time after another note has been entered after said one note was entered;

a meter determining unit which determines a meter of the performance information based on the tempo determined by the tempo determining unit; and a note-duration ratio calculating unit which calculates a ratio of a second entered note duration to a first entered note duration, wherein (i) the first entered note duration is a duration of said one note out of at least the two notes in the performance information and (ii) the second entered note duration is a duration of a note entered after said one note, and wherein the tempo determining unit determines a tempo of the performance information based on the first entered note duration and the ratio calculated by the note-duration ratio calculating unit.

3. The performance-information processing apparatus according to claim 1, wherein the second timing corresponds to a time point at which a time interval has lapsed from the starting time point, at which said one note out of at least the two notes in the performance information started entering, the time interval being determined based on the tempo determined by the tempo determining unit and corresponding to a predetermined number of beats, and the meter determining unit determines a meter of the performance information, when the time interval corresponding to the predetermined number of beats has lapsed after the starting time point, at which said one note out of at least the two notes in the performance information started entering.

4. The performance-information processing apparatus according to claim 1, wherein the meter determining unit determines a meter of the performance information by examining the performance information entered in a time interval corresponding to a predetermined number of beats and determined based on the tempo determined by the tempo determining unit, after the starting time point, at which said one note out of at least the two notes in the performance information started entering.

5. The performance-information processing apparatus according to claim 4, wherein the meter determining unit determines a meter of the performance information by examining at least one of the performance information at the third beat, the fourth beat, the eighth beat, and the ninth beat measured on the basis of the starting time point, at which said one note out of at least the two notes in the performance information started entering.

6. The performance-information processing apparatus according to claim 1, further comprising:

a maximum note-duration selecting unit which selects a note having a maximum duration from among notes in the performance information entered in a time interval between (i) the starting time point, at which said one note out of at least the two notes in the performance information starts entering and (ii) a third timing determined based on the tempo determined by the tempo determining unit, wherein the meter determining unit determines a meter of the performance information, in accordance with a timing of the note having the maximum duration selected by the maximum note-duration selecting unit in the performance information.

7. The performance-information processing apparatus according to claim 6, further comprising:

an anacrusis judging unit which judges whether an anacrusis occurs in the performance information, wherein the meter determining unit determines a meter of the performance information by using as a reference a timing of the note having the maximum duration selected by the maximum note-duration selecting unit in the performance information, when the anacrusis judging unit determines that the anacrusis occurs in the performance information.

8. The performance-information processing apparatus according to claim 1, wherein the meter determining unit determines a meter of the performance information by comparing (i) the performance information entered in a time interval corresponding to a first predetermined group of beats after the starting time point, with (ii) the performance information entered in a time interval corresponding to a second predetermined group of beats after the starting time point, based on the tempo determined by the tempo determining unit.

9. The performance-information processing apparatus according to claim 2, wherein the tempo determining unit judges whether the tempo of the performance information is faster than a tempo of previously entered performance information, in accordance with a duration of the first entered-note duration.

10. The performance-information processing apparatus according to claim 2, wherein the tempo determining unit has a table for outputting a value of the tempo, based on the first entered-note duration and the ratio calculated by the note-duration ratio calculating unit.

11. The performance-information processing apparatus according to claim 1, wherein, when it is determined that the entering of the performance information reaches a predetermined time point after the starting time point, (i) the tempo determining unit starts determining a tempo of performance information after the predetermined time point, and (ii) the meter determining unit starts determining a meter of the performance information after the predetermined time point, by treating the predetermined time point as a new starting time point at which said one note will start entering, again.

12. A method of processing performance information, comprising:

determining a tempo of performance information, based on the performance information entered in a time interval between (i) a starting time point, at which one note out of at least two notes in the performance information starts entering and (ii) a first timing, that is a certain time after another note has been entered after said one note was entered; and determining a meter of the performance information based on the determined tempo, wherein determining the meter comprises determining a meter of the performance information, based on the performance information entered in a time interval between (i) the starting time point, at which said one note out of at least the two notes in the performance information starts entering and (ii) a second timing, which is determined based on the determined tempo.

13. A non-transitory computer-readable recording medium with a computer program stored thereon, the computer program being executable by a computer to cause the computer to execute functions comprising:

determining a tempo of performance information, based on the performance information entered in a time interval between (i) a starting time point, at which one note out of at least two notes in the performance information starts entering and (ii) a first timing, that is a certain time after another note has been entered after said one note was entered; and determining a meter of the performance information based on the determined tempo, wherein determining the meter comprises determining a meter of the performance information, based on the performance information entered in a time interval between (i) the starting time point, at which said one note out of at least the two notes in the performance information starts entering and (ii) a second timing, which is determined based on the determined tempo.

14. The performance-information processing apparatus according to claim 2, wherein the meter determining unit determines a meter of the performance information by examining the performance information entered in a time interval corresponding to a predetermined number of beats and determined based on the tempo determined by the tempo determining unit, after the starting time point, at which said one note out of at least the two notes in the performance information started entering.

15. The performance-information processing apparatus according to claim 14, wherein the meter determining unit determines a meter of the performance information by examining at least one of the performance information at the third beat, the fourth beat, the eighth beat, and the ninth beat measured on the basis of the starting time point, at which said one note out of at least the two notes in the performance information started entering.

16. The performance-information processing apparatus according to claim 2, further comprising:

a maximum note-duration selecting unit which selects a note having a maximum duration from among notes in the performance information entered in a time interval between (i) the starting time point, at which said one note out of at least the two notes in the performance information starts entering and (ii) a third timing determined based on the tempo determined by the tempo determining unit, wherein the meter determining unit determines a meter of the performance information, in accordance with a timing of the note having the maximum duration selected by the maximum note-duration selecting unit in the performance information.

17. The performance-information processing apparatus according to claim 16, further comprising:

an anacrusis judging unit which judges whether an anacrusis occurs in the performance information, wherein the meter determining unit determines a meter of the performance information by using as a reference a timing of the note having the maximum duration selected by the maximum note-duration selecting unit in the performance information, when the anacrusis judging unit determines that the anacrusis occurs in the performance information.

18. The performance-information processing apparatus according to claim 2, wherein the meter determining unit determines a meter of the performance information by comparing (i) the performance information entered in a time interval corresponding to a first predetermined group of beats after the starting time point, with (ii) the performance information entered in a time interval corresponding to a second predetermined group of beats after the starting time point, based on the tempo determined by the tempo determining unit.

19. The performance-information processing apparatus according to claim 2, wherein, when it is determined that the entering of the performance information reaches a predetermined time point after the starting time point, (i) the tempo determining unit start determining a tempo of performance information after the predetermined time point, and (ii) the meter determining unit start determining a meter of the performance information after the predetermined time point, by treating the predetermined time point as a new starting time point at which said one note will start entering, again.

20. A musical instrument comprising the performance-information processing apparatus according to claim 1.

* * * * *